United States Patent [19]

Tanioka et al.

[11] Patent Number: 4,888,521

[45] Date of Patent: Dec. 19, 1989

[54] PHOTOCONDUCTIVE DEVICE AND METHOD OF OPERATING THE SAME

[75] Inventors: Kenkichi Tanioka, Tokyo; Keiichi Shidara; Tatsuro Kawamura, both of Tama; Junichi Yamazaki, Kawasaki; Eikyuu Hiruma, Komae; Kazuhisa Taketoshi, Sagamihara; Shiro Suzuki, Yokosuka; Takashi Yamashita, Sagamihara; Mitsuo Kosugi, Tokyo; Yochizumi Ikeda, Tokyo; Masaaki Aiba, Tokyo; Tadaaki Hirai, Koganei; Yukio Takasaki, Kawasaki, all of Japan; Sachio Ishioka, Burlingame, Calif.; Tatsuo Makishima, Mitaka, Japan; Kenji Sameshima, Hachioji, Japan; Tsuyoshi Uda, Kodaira, Japan; Naohiro Goto, Machida, Japan; Yasuhiko Nonaka; Eisuke Inoue, both of Mobara, Japan; Kazutaka Tsuji; Hirofumi Ogawa, both of Hachioji, Japan

[73] Assignees: Hitachi Ltd.; Nippon Hoso Kyokai, both of Tokyo, Japan

[21] Appl. No.: 69,156

[22] Filed: Jul. 2, 1987

[30] Foreign Application Priority Data

| | | | |
|---|---|---|---|
| Jul. 4, 1986 | [JP] | Japan | 61-156317 |
| Oct. 29, 1986 | [JP] | Japan | 61-255671 |
| Oct. 29, 1986 | [JP] | Japan | 61-255672 |
| Nov. 25, 1986 | [JP] | Japan | 61-278635 |
| Jan. 14, 1987 | [JP] | Japan | 62-4865 |
| Jan. 14, 1987 | [JP] | Japan | 62-4867 |
| Jan. 14, 1987 | [JP] | Japan | 62-4869 |
| Jan. 14, 1987 | [JP] | Japan | 62-4871 |
| Jan. 14, 1987 | [JP] | Japan | 62-4872 |
| Jan. 14, 1987 | [JP] | Japan | 62-4873 |
| Jan. 17, 1987 | [JP] | Japan | 62-4875 |
| Jun. 17, 1987 | [JP] | Japan | 62-149023 |

[51] Int. Cl.[4] ..... H01J 31/38

[52] U.S. Cl. ..... 313/366; 313/387

[58] Field of Search ..... 313/498, 499, 501, 366, 313/367, 368, 384, 385, 386, 387

[56] References Cited

U.S. PATENT DOCUMENTS

| | | | |
|---|---|---|---|
| 3,885,189 | 5/1975 | Picker et al. | 313/366 X |
| 4,128,844 | 12/1978 | Illenberger et al. | 357/31 |
| 4,488,083 | 12/1984 | Inoue et al. | 313/366 |

FOREIGN PATENT DOCUMENTS

| | | |
|---|---|---|
| 151754 | 12/1984 | European Pat. Off. . |
| 163468 | 4/1985 | European Pat. Off. . |
| 276683 | 3/1988 | European Pat. Off. . |
| 283699 | 9/1988 | European Pat. Off. . |
| 43-18643 | 8/1968 | Japan . |
| 49-24619 | 3/1974 | Japan . |
| 52-144992 | 2/1977 | Japan . |
| 60-140288 | 1/1987 | Japan . |
| 824918 | 12/1959 | United Kingdom . |

OTHER PUBLICATIONS

Physics of Semiconductor Devices, Sze, 12/69, pp. 56–65.

"Electron and Hole Ionizations Rate in Epitaxial Silicon at High Electron Fields", Grant, Solid State Electronics, vol. 16, pp. 1189–1203, 12/73.

Physica Status Solidi(a), vol. 59, pp. 389–393, Juska et al., 12/80.

Appl. Phys. Lett. 36(4), Umebu et al., pp. 302–303, 2/80.

Physica Status Solidi(a), vol. 77, pp. 387–391, Juska et al., 12/83.

*Primary Examiner*—Kenneth Wieder

*Attorney, Agent, or Firm*—Antonelli, Terry & Wands

[57] ABSTRACT

A photoconductive device having a photoconductive layer which includes an amorphous semiconductor layer capable of charge multiplication in at least a part thereof is disclosed. The method of operating such a photoconductive device is also disclosed. By using the avalanche effect of the amorphous semiconductor layer, it is possible to realize a highly sensitive photoconductive device while maintaining low lag property.

46 Claims, 12 Drawing Sheets

PHOTOCONDUCTIVE DEVICE AND METHOD OF OPERATING THE SAME

RELATED APPLICATIONS

This application relates to U.S. Application Ser. No. 07/067,229, filed June 29, 1987, based on Japanese Patent Application No. 61-149553 filed June 27, 1986.

BACKGROUND OF THE INVENTION

1. Field of the Invention

The present invention relates to a photoconductive device and, a method for operating the same and in particular, to a photoconductive device mainly composed of amorphous semiconductors and including a photoconductive layer having significantly raised sensitivity and blocking contact under the state that fine photo response is maintained, and to its operating method.

Photoconductive devices according to the present invention include solid-state photoconductive devices of laminated photoconductive layer type such as photocells, one dimensional image sensors and two dimensional image sensors, and photoconductive devices represented by photoconductive image pick-up tubes. Further, photoconductive devices according to the present invention include photoconductive devices used to read out the signal charge by means of electronic switches or the like and photoconductive devices used for optical communication or the like.

2. Description of the Related Art

Photoconductive devices composed mainly of amorphous semiconductors include solid-state photoconductive devices of laminated photoconductive layer type such as photocells, one dimensional image sensors described in JP-A-52-144992, laid-open on Dec, 2, 1977, for example, and two dimensional image sensors composed of combination of solid-state drive circuits and amorphous photoconductors disclosed, for example, JP-A-49-24619, laid-open on Mar. 5, 1974 (corresponding to Japanese Patent Application No. 47-59514, filed July 3, 1972). Such photoconductive devices also include photoconductive image pick-up tubes. In solid-state photoconductive devices of laminated photoconductive layer type such as photocells and one dimensional image sensors among the prior art devices, an electrode having such contact as to block the charge injection is usually used with respect to the photoconductive layer in order to attain fine photo response. However, it has heretofore been impossible to realize a device which is capable of extracting the signal charge exceeding the number of carriers generated by the incident light. That is to say, the gain of photoelectric conversion was below unity.

As targets for photoconductive image pick-up tubes, so-called targets of blocking type described in JP-A-49-24619, for example, and so-called targets of injection type are used. The target of blocking type has such a structure that charge injection from the signal electrode side and the electron beam scanning side is prevented. The target of injection type has such a structure that the charge is injected from the signal electrode side and/or the electron beam side. The target of blocking type has a feature that the lag can be reduced. Because of absense of multiplying function at the photoconductive layer, however, a highly sensitive target of blocking type having a gain larger than unity has not heretofore been obtained.

On the other hand, more electrons than incident electrons can be introduced into an external circuit in accordance with the principle of the target of injection type. Accordingly, there is a possibility of increasing the sensitivity so as to attain a gain larger than unity. A highly sensitive image pick-up tube using a monocrystalline semiconductor target plate of np structure has already been proposed in JP-A-43-18643 (published on Aug. 13, 1967). There has also been proposed a highly sensitive image pick-up tube having an electron injection and recombination layer at the beam scan side of the photoconductive layer in order to inject scanning electrons and recombine scanning electrons with holes (JP-A-62-2435, laid-open on Jan. 8, 1987 corresponding to Japanese Patent Application No. 60-140288, filed on June 28, 1985).

In accordance with any of the above-described techniques having a high sensitivity of a target of an image pick-up tube of photoconductive type to attain the gain larger than unity, however, a part of scanning electrons is injected into the target of the image pick-up tube. In principle, therefore, the effective storage capacitance of the target is disadvantageously increased and hence the lag is increased.

The image pick-up tube having a semiconductor target plate described in the aforementioned JP-A-43-18643 must satisfy the condition $T_t < T_n \leqq T_e$, where $T_t$ represents the average scanning time required for scanning electrons which have reached a p-type monocrystalline semiconductor layer to reach a signal electrode through an n-type monocrystalline semiconductor layer, and $T_n$ and $T_e$ represent the average life of electrons in the p-type monocrystalline semiconductor layer and scanning time required for the scanning electron beam to scan one picture element, respectively. In addition, it is difficult to obtain a monocrystalline semiconductor substrate of good quality. In case Si single crystal is used as the monocrystalline substrate, the resistivity of the substrate is low and hence the np structure must be separated in the mosaic form as described in the above described JP-A-43-18643. It was not desirable in raising the resolution of the image pick-up tube.

SUMMARY OF THE INVENTION

An object of the present invention is to provide a photoconductive device having raised sensitivity and an operation method for such a photoconductive device.

Another object of the present invention is to provide a photoconductive device having a photoelectric conversion gain larger than unity and an operation method for such a photoconductive device.

A further object of the present invention is to provide a photoconductive device having a fine photo response and an operation method for such a photoconductive device.

A further object of the present invention is to provide a photoconductive device having a uniform photoconductive layer which can be easily increased in area and provide an operation method for such a photoconductive device.

A further object of the present invention is to provide a photoconductive device which can be easily fabricated and an operation method for such a photoconductive device.

A further object of the present invention is to provide a photoconductive device having a small dark current and an operation method for such a photoconductive device.

A further object of the present invention is to provide a photoconductive device which is not liable to sticking and provide an operation method for such a photoconductive device.

A further object of the present invention is to provide a photoconductive device having a photoconductive layer which is not liable to defects and provide an operation method for such a photoconductive device.

In order to achieve the above described objects, according to an aspect of the present invention, an amorphous semiconductor layer capable of charge multiplication is used in at least a part of a photoconductive layer of a photoconductive device, which layer has a structure of charge injection blocking type.

Further, according to another aspect of the present invention, within the above described amorphous semiconductor layer, the above described photoconductive layer is operated in an electric field region fulfilling the above described charge multiplication function.

With those and other objects in view, the invention consists in the construction and the methods hereafter fully described, illustrated in the accompanying drawings, and set forth in the claims hereto appended, it being understood that various changes in the operation, form, proportion and minor details of construction, within the scope of the claims, may be resorted to without departing from the spirit the invention or sacrificing any of the advantages thereof.

DESCRIPTION OF THE PREFERRED EMBODIMENTS

The present inventors found that charge multiplication (avalanche effect) occurs inside the amorphous semiconductor layer when a strong electric field is applied to the amorphous semiconductor layer. Such charge multiplication in an amorphous semiconductor has been confirmed by the present inventors for the first time.

Figure 3:
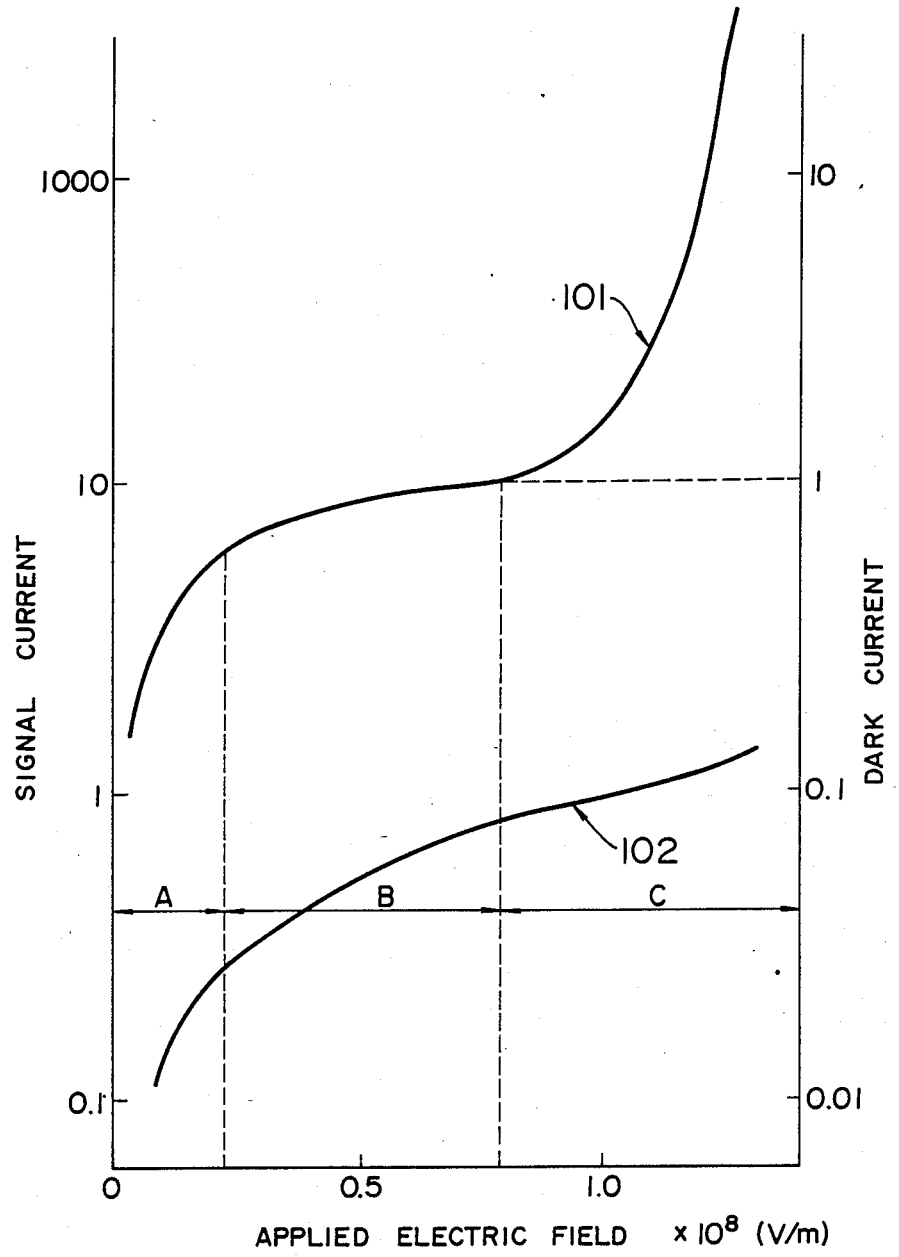
FIGS. 3, 4, 5, 6, 7 and 8 are drawings used for explaining the characteristics of a photoconductive device according to the present invention.

Prior to explaining the embodiments of the present invention, the charge multiplication in the amorphous semiconductor layer of a photoconductive device according to the present invention will first be described by referring to FIG. 3. FIG. 3 shows the output signal current of a photoconductive device as a function of the applied electric field (curve 101) and shows the dark current as a function of the applied electric field (curve 102), when a transparent electrode, a thin ceria layer, an amorphous Se layer and an Au electrode are successively piled up on a transparent glass substrate of the photoconductive device. FIG. 3 shows the relation between the optical signal current and the applied voltage and the relation between the dark current and the applied voltage, when the light is radiated onto the photoconductive device from the glass substrate side under the state that voltage is applied to electrodes so that the transparent electrode will be positive with respect to the Au electrode. The applied voltage is represented by the electric field strength.

The ceria layer located between the transparent electrode and the amorphous Se layer functions to prevent the hole injection. And the number of electrons injected from the Au electrode to the amorphous Se layer is very small. As a result, the present photoconductive device operates as the so-called photoconductive device of blocking type. As evident from FIG. 3, the relation between the signal current and the applied voltage can be divided into three regions A, B and C.

Figure 4:
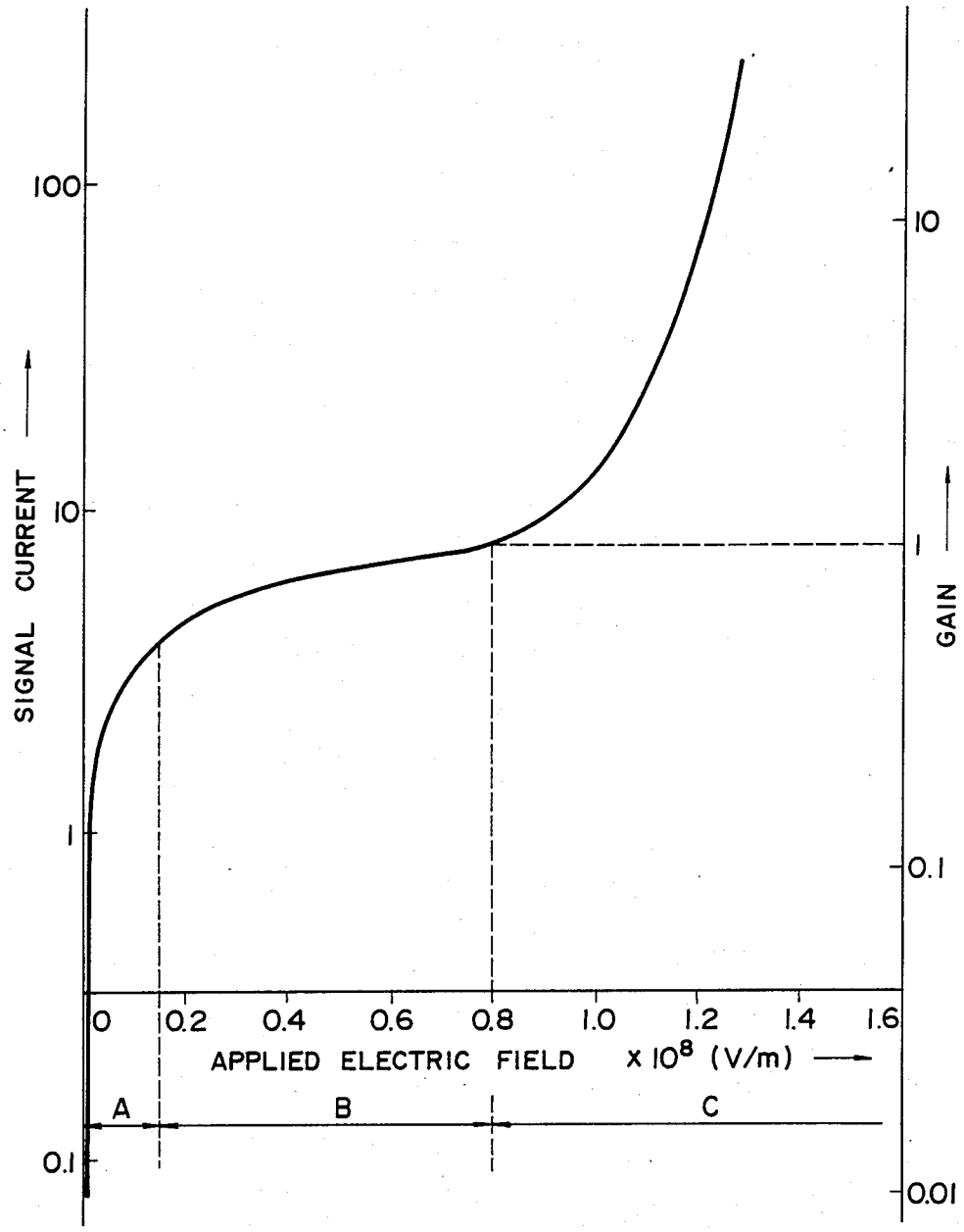

FIG. 4 shows an example of the above described charge multiplication examined for the target of a photoconductive image pick-up tube. FIG. 4 shows the relation between the output signal current and the target voltage of a target of an image pick-up tube derived by successively depositing a transparent conductive layer, a thin ceria layer, an amorphous Se layer and a $Sb_2S_3$ layer on a transparent glass substrate. FIG. 4 shows the relation between the optical signal current and the applied voltage derived when the light is radiated from the glass substrate side under the state that voltage is so applied to the target that the conductive layer will have a positive potential as compared with the $Sb_2S_3$ layer. The target voltage is represented by the electric field strength.

The ceria layer prevents the hole injection. Further, the $Sb_2S_3$ layer prevents scanning electrons from flowing into the amorphous Se. Accordingly, the target of the present image pick-up tube functions as the socalled blocking type target. As evident from FIG. 4, the relation between the signal current and the applied voltage is composed of three regions A, B and C in the target of this photoconductive image pick-up tube as well.

The region C of FIG. 3 or 4 is the operation region used by the photoconductive device according to the present invention. Prior to description of the operation region C, other operation regions A and B will now be described.

Figure 2:
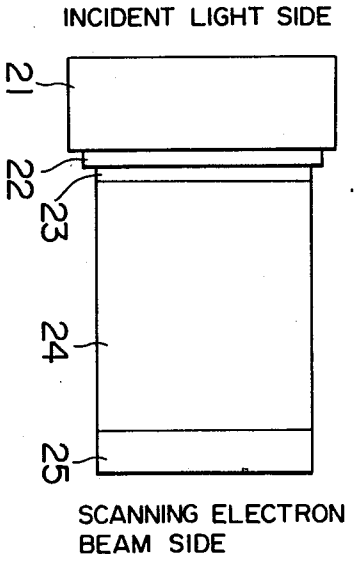
FIG. 2 shows an example of structure of a photoconductive device according to the present invention.

At first, the operation of the region A will now be described. Incident photons which have been passed through a transparent substrate 21, a transparent electrode 22 and an auxiliary rectifying contact layer 23 of FIG. 2, for example, generate electron-hole pairs in an amorphous semiconductor layer 24. FIG. 2 shows an example of structure of a photoconductive device according to the present invention. When the applied electric field is increased from zero, the generated electron-hole pairs are partly separated. The resultant electrons proceed to the transparent electrode 22 and the holes reach the blocking layer 25. At this time, probability of separation of the electron-hole pairs becomes greater as the electric field is increased. Therefore, as the applied electric field is increased in strength as shown in FIG. 3, the signal current increases. The operation of the region A has heretofore been described. In the operation of the region A, the number of the electron-hole pairs generated in the amorphous semiconductor layer 24 is always less than the number of the incident photons. The gain of the photoconductive layer does not exceed unity. In this case, it is a matter of course that amplification is absent in the photoconductive layer.

Succeedingly, the operation in the region B will now be described. If the electric field of the photoconductive layer 24 shown in FIG. 2 becomes strong enough to separate most of electron-hole pairs generated by the incident photons and make electrons and holes proceed respectively to the transparent electrode 22 and the electron injection blocking layer 25 without recombining them, the signal current tends to be saturated. Even if the electric field is further strengthened, the signal current does not largely increase. The operation of the region B has heretofore been described. In the operation of the region B, recombination is reduced as compared with the operation of the above described region A. However, the number of electron-hole pairs generated in the amorphous semiconductor layer 24 is always smaller than the number of incident electrons. Accordingly, the gain of the photoconductive layer is unity even at its maximum value. That is to say, amplification at the photoconductive layer is absent in case of the region B as well. The blocking type target described before in "DESCRIPTION OF THE RELATED ART" is operated in the region B just described.

The region C which is an operation region of the photoconductive device according to the present invention will now be described. The present inventors found that when the applied electric field is further strengthened from the above described region B, charge multiplication occurs in the amorphous semiconductor layer 24 of FIG. 2 and the signal current abruptly increases, resulting in the gain not less than unity. The present invention is directed to raising the sensitivity of the photoconductive device utilizing the effect of charge multiplication caused in the above described region C.

Figure 5:
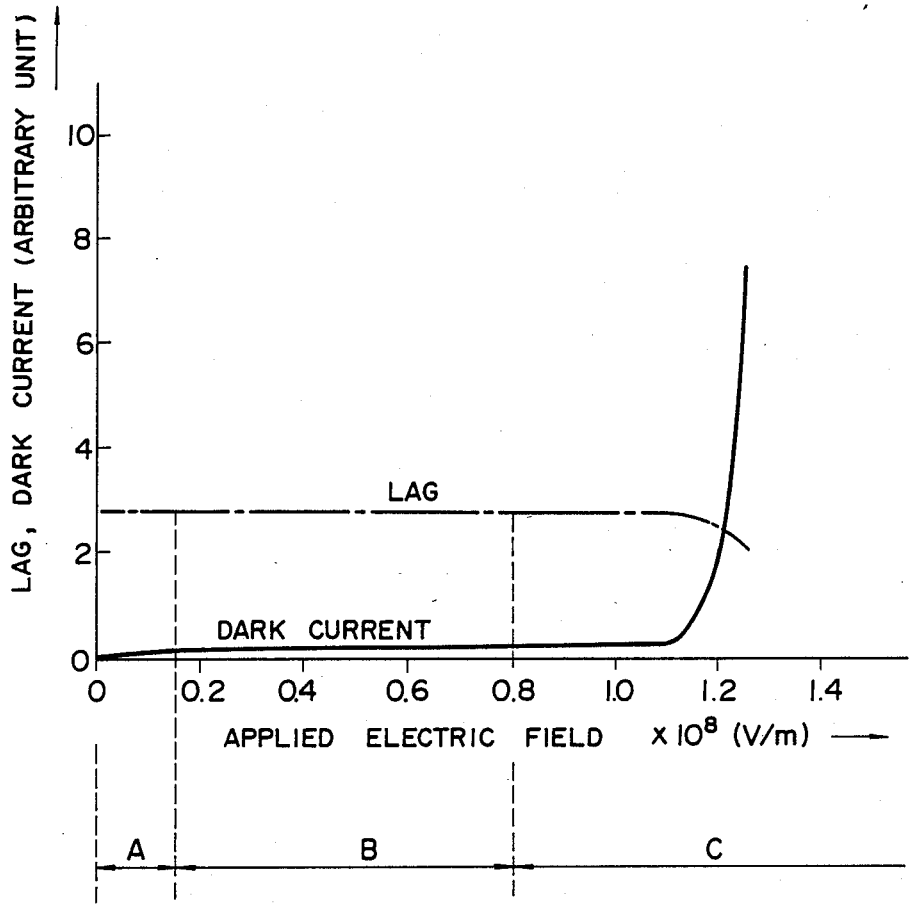

Physical interpretation of the charge multiplication caused in the operational electric field of the region C is not sufficient yet. In FIG. 5 which shows the relation of the present embodiment between the applied electric field, dark current and lag, the lag increase in the region C of the present invention having a gain not less than unity is not perceptible at all as compared with the region B. In the region C as well, the dark current does not increase largely excepting a part of the region C where the gain extremely increases. Therefore, it is evident that the charge multiplication in the photoconductive device according to the present invention is not the multiplication caused by the charge injection as described before in "DESCRIPTION OF THE RELATED ART" but unknown multiplication caused when a strong electric field is applied to a blocking type photoconductive layer using an amorphous semiconductor.

As described above, an electric field corresponding to the region C is applied to the photoconductive layer of a photoconductive device having a structure as shown in FIG. 2, for example. If the light is radiated from the side of the transparent substrate 21 under that state, a greater part of the incident light is absorbed mainly at the side of the transparent electrode 21 of the amorphous semiconductor layer 24 to generate electron-hole pairs. Among these, electrons flow to the side of the transparent electrode 21. However, holes run in the amorphous semiconductor layer 24 toward the electron injection blocking layer 25. By providing the amorphous semiconductor layer 24 with such thickness that charge multiplication is caused to attain desired characteristics when holes run under the high electric field in the amorphous semiconductor layer 24, therefore, it is possible to obtain high sensitivity with a gain larger than unity while maintaining the low lag property of the photoconductive layer of the photoconductive device.

In case of crystal semiconductors, such charge multiplication is already known as avalanche multiplication phenomenon. The crystal semiconductor has problems that microplasma is caused and the dark current is as large as $10^{-9}$ A/mm$^2$. In addition, the dark current cannot be restricted to a low value when the sectional area of the device is large. Therefore, the crystal semiconductor has not heretofore been put into practical use as a two dimensional photoelectric conversion device for image pick-up tubes or the like. On the other hand, an amorphous semiconductor usually has many internal defects. Therefore, it has been considered that such phenomenon does not occur in the amorphous semiconductor. In fact, multiplication phenomenon in the amorphous semiconductor has not been disclosed until now. As a result of detailed study by the present inventors, however, it has been found that the charge multiplication exists in the amorphous semiconductor and its dark current does not exceed one hundredth that of the crystal semiconductor despite its large area.

As a result of further detailed study, the present inventors found that charge multiplication is slight for electrons while it is significant for holes. The usual photoconductive image pick-up tube is a device using an operation scheme in which holes run within a photoconductive layer. If the above described phenomenon in the amorphous semiconductor is used in a photoconductive image pick-up tube, therefore, it is possible to amplify charges with low noise and good efficiency. For amorphous semiconductors, it is easy to form a thin film having uniform quality and a large area and it is possible to form the target portion of the image pick-up tube by using a simple process. The photoconductive device according to the present invention using an amorphous semiconductor material and its operation method are extremely effective.

Figure 12:
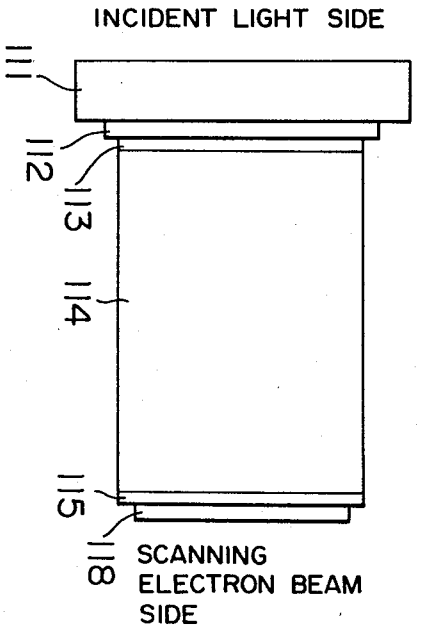
FIG. 12 shows an embodiment of a photoconductive device according to the present invention.

FIGS. 2 and 12 show examples of structures of photoconductive devices according to the present invention. Substrates 21, 111, electrodes 22, 112 and photoconductive layers 24, 114 having an amorphous semiconductor layer are illustrated respectively. The photoconductive layers 24, 114 are constructed such that rectifying contact is provided between the photoconductive layers 24, 114 and the transparent electrodes 22, 112 so that injection of the holes from the transparent electrodes 22, 112 are prevented. Although not required when the photoconductive device is used as an image pick-up tube, a pairing electrode 118 may be required as shown in FIG. 12 in other applications of the photoconductive device.

Further, it is also important for the present invention to provide electron injection blocking layers 25, 115 in order to block injection of electrons.

In case sufficient rectifying contact is not obtained between the electrodes 22, 112 and the photoconductive layers 24, 114, it is also effective to insert auxiliary layers 23, 113 rectifying contact between them to enhance the rectifying contact function.

The preset invention will now be described in detail by referring to an image pick-up tube as the embodiment.

In accordance with the present invention, charge multiplication is caused in an amorphous semiconductor layer capable of charge multiplication when strong electric field is applied to the amorphous semiconductor, and such a target structure is employed to effectively cause the charge multiplication. It is thus possible to obtain an image pick-up tube having high sensitivity with gain larger than unity without increasing the lag.

Especially in case the above described photoconductive layer is formed by an amorphous semiconductor layer mainly comprising selenium, it is possible to obtain suitable charge multiplication at least in the range of $5\times10^7$ V/m to $2\times10^8$ V/m of the electric field region causing charge multiplication.

Figure 1:
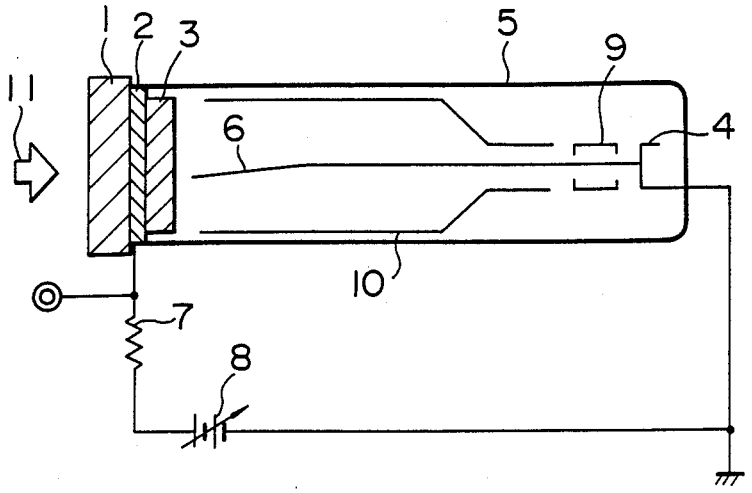
FIG. 1 shows the structure of an image pick-up tube which is an embodiment of a photoconductive device according to the present invention.

FIG. 1 shows an example of principle structure of an image pick-up tube according to the present embodiment.

The image pick-up tube comprises a target portion composed of a transparent substrate 1, a transparent electrode 2 and a photoconductive layer 3. And the image pick-up tube is made by hermetically sealing electrodes 4, 9 and 10 for emitting, accelerating, deflecting and focusing an electron beam 6 into the vacuum in a glass tube 5.

Electrons emitted from the cathode 4 are accelerated by voltage applied to the acceleration electrode 9 and deflected and focused by voltage applied to the deflection and focusing electrode 10. The resultant electron beam 6 scans the face of the photoconductive layer 3. In a part scanned by the electron beam, a closed circuit passing through the electron beam, the transparent electrode 2, an external resistance 7 and a power source 8 is formed. The photoconductive layer 3 is charged almost up to voltage of power source 8 in such a direction that the electron beam scanning side assumes negative potential. If light 11 is radiated under this state, the light transmitted through the transparent substrate 1 is absorbed by the photoconductive layer 3 to generate optical carriers. These optical carriers are separated by the electric field within the photoconductive layer 3 defined by the power source 8. The separated carriers run in the photoconductive layer 3. Holes among optical carriers run toward the electron beam scanning side and electrons run toward the transparent electrode 2. The potential difference between both ends of the photoconductive layer 3 which has been charged as described before is reduced. Therefore, by making the dark resistance of the photoconductive layer 3 sufficiently large, electric charge pattern is generated on the surface at the electron beam scanning side of the photoconductive layer 3 in accordance with incident light amount.

When the photoconductive layer 3 is subsequently scanned by the electron beam 6, the photoconductive layer 3 is so charged as to supplement this reduction in potential difference. The current flowing through the external resistance 7 at this time is taken out as the signal.

The above-mentioned process is common with the operation of prior art image pick-up tube of photoconductive type having a blocking type target. However, in the present invention, an amorphous semiconductor having a charge multiplication function is used at least in a portion of the photoconductive layer. If an electric field strong enough to cause the charge multiplication in the amorphous semiconductor layer is applied to the image pick-up tube of FIG. 1, the optical carriers running in the photoconductive layer 3 are strongly accelerated to have high energy and generate new electron-hole pairs by that energy. These carriers are again accelerated and increases in avalanche in the photoconductive layer. In this case, therefore, the decrease in potential difference caused by the above described process becomes larger as compared with the case of a conventional image pick-up tube where the number of carriers is not multiplied in a photoconductive layer. As a result, the current flowing during the recharging process becomes large. That is to say, high sensitivity is obtained.

If such a strong electric field as to cause charge multiplication inside the amorphous semiconductor layer is applied to the amorphous semiconductor layer, the rectifying contact, namely the hole injection blocking function or the function of blocking electron injection from the scanning beam, becomes insufficient and hence the dark current is increased, or local dielectric breakdown is caused, giving rise to a problem of raising a possibility of picture defects such as white spots on the monitor picture tube. These drawbacks can be eliminated by adding a specific material into the amorphous semiconductor layer to control the electric field distribution within the amorphous semiconductor layer as described below.

At first, the present inventors found that it was effective to put a material forming hole traps in an amorphous semiconductor layer mainly comprising Se into at least a part of the amorphous semiconductor layer for the purpose of enhancing the hole injection blocking function or restraining the occurrence of white spots. As a material forming hole traps in such an amorphous semiconductor layer, at least one selected out of a group composed of Li, Na, K, Mg, Ca, Ba and Tl as well as their fluorides and fluorides of Al, Cr, Mn, Co, Pb and Ce is extremely effective. The fluoride among them may be one having stoichiometric composition such as LiF, NaF, $MgF_2$, $CaF_2$, $BaF_2$, $AlF_3$, $CrF_3$, $MnF_2$, $CoF_2$, $PbF_2$, $CeF_2$, TlF or KF or one having different composition. As a result of further detailed study, such a material forming hole traps in an amorphous semiconductor layer need not necessarily be distributed with uniform concentration but may change in concentration with respect to the layer thickness direction of the amorphous semiconductor layer. Or such a material may be contained in at least a part of the layer thickness direction. Especially in case such a material is added to the light incidence side of the amorphous semiconductor layer, the electric field near the electrode interface can be lightened without hampering the charge multiplication. It has been thus made clear that such a material brings about significant effects.

It is important that the photoconductive device has a blocking-type structure and at least one of materials forming hole traps in the amorphous semiconductor layer is contained in at least a part of the amorphous semiconductor layer forming at least a part of the photoconductive layer.

Figure 6:
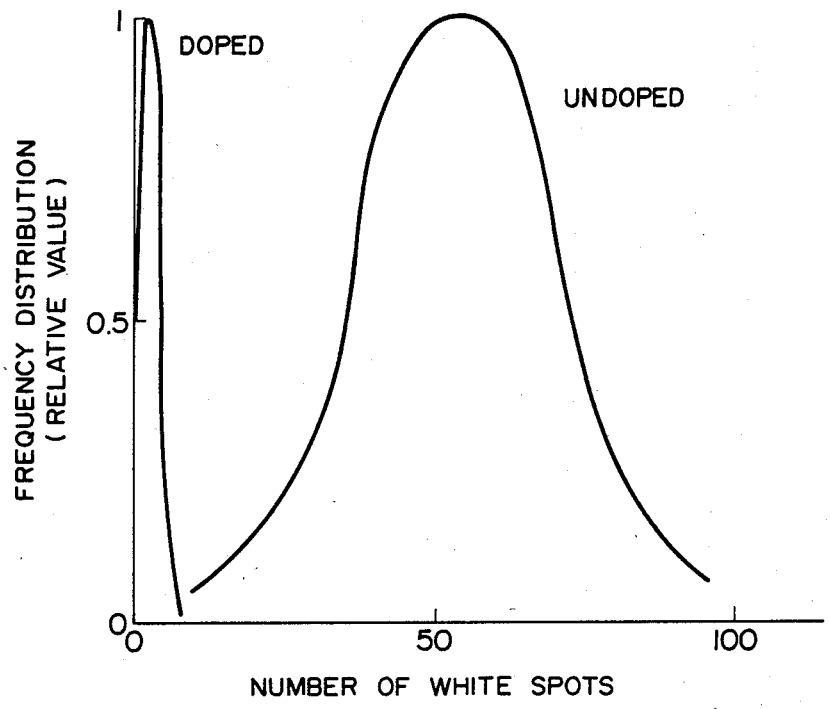

FIG. 6 shows white spots occurrence found in a target containing 2,000 weight ppm of LiF in a part of an amorphous semiconductor layer mainly composed of Se as compared with another target with no LiF added. These white spots generated when high voltages were applied to the image pick-up tubes having these targets to cause the charge multiplication in the amorphous semiconductor layers. It is evident from FIG. 6 that it becomes possible to control the electric field within the photoconductive layer and reduce largely the white spots occurrence rate without hampering the charge multiplication by putting LiF into at least a part of the amorphous semiconductor layer.

The effect obtained by adding the above described material forming hole traps in the amorphous semiconductor layer is not sufficient if the additive concentration is low. If the additive concentration is too high, the electric field in the above described amorphous semiconductor layer tends to vary and there is a fear of sticking. Accordingly, the local concentration of the above described additive in the layer thickness direction of the amorphous semiconductor layer is desired to be not less than 20 weight ppm and not higher than 10 weight %.

Explanation will now be presented of a means for enhancing the electron injection blocking function.

By increasing the thickness of the electron injection blocking layer in an attempt to enhance the electron scanning beam blocking function, the dark current can be made small. However, at the same time, this raises a possibility of obtaining a picture quality degradation.

It is now assumed that such strong electric field as to cause charge multiplication inside an amorphous semiconductor layer mainly comprising Se is applied to the amorphous semiconductor layer. In this case, the present inventors found that it was effective to put a material forming electron traps in the amorphous semiconductor layer into at least a part of the amorphous semiconductor layer for the purpose of enhancing the blocking function with respect to the scanning electron beam. Owing to this method, the current can be made small by increasing the layer thickness of the blocking layer at the scanning electron beam side. It is not necessary to enhance the blocking function with respect to the scanning electron beam. Deterioration in picture quality due to the increased lag is also avoided. In addition, it is possible to obtain fine dark current characteristics without hampering the charge multiplication.

As such a material forming electron traps in the amorphous semiconductor layer, at least one selected from a group consisting of copper oxide, indium oxide, selenium oxide, vanadium oxide, molybdenum oxide, tungsten oxide, gallium fluoride, indium fluoride, Zn, Ga, In, Cl, I and Br was found to be extremely effective.

The oxide and the fluoride may have stoichiometric composition like CuO, $In_2O_3$, $SeO_2$, $V_2O_5$, $MoO_3$, $WO_3$, $GaF_3$ or $InF_3$ or may have a composition ratio displaced therefrom.

As a result of further detailed study by present inventors, it has been made clear that significant effects are obtained when the material forming electron traps in the amorphous semiconductor layer is added near the electron beam scanning side because the electric field near the electron beam scanning side can be lightened without hampering the charge multiplication. It has also been made clear that the additive need not necessarily be distributed with uniform concentration with respect to the layer thickness direction of the photoconductive layer but may vary in concentration. If the concentration of a material forming the electron traps added to at least a part of the layer thickness direction of the amorphous semiconductor layer mainly comprising Se is low, the effect of the present invention is not sufficient. If the concentration is too high, there is a fear that sticking tends to occur.

Therefore, it is desirable that the local concentration of the material forming electron traps added to the amorphous semiconductor layer is not lower than 20 weight ppm and not higher than 10 weight % in the layer thickness direction of the amorphous semiconductor layer.

If a plurality of kinds of materials are added, the value of the additive concentration is the sum of concentrations of respective additives. It has also been made clear that the effect is further enhanced by forming a layer with at least one of As and Ge added to at least a part of the vicinity of the electron beam scanning side concurrently with adding the material forming electron traps.

TABLE 1

| Gain | Dark current (nA) Target (I) | Target (II) |
|---|---|---|
| 5 | 0.2 to 0.3 | 10 to 13 |
| 10 | 0.3 to 3.0 | 13 to 20 |

Table 1 compares the dark current characteristics of a target (I) with those of a target (II). The target (I) contains indium oxide of 2,000 weight ppm and As of 38.8 weight % in a part of the vicinity of the electron beam scanning side of the amorphous semiconductor layer mainly comprising Se in accordance with the present invention. The present invention has not been applied to the target (II). In the ensuing description of the present invention, the concentration of the material added to the amorphous semiconductor layer is represented by a weight ratio in any case. In case the present invention has been applied, it is evident from Table 1 that it is possible to control the electric field in the target and largely decrease the dark current without hampering the charge multiplication.

The above described means for adding a material forming hole traps in the amorphous semiconductor layer may be combined with means for adding a material forming electron traps.

Figure 7:
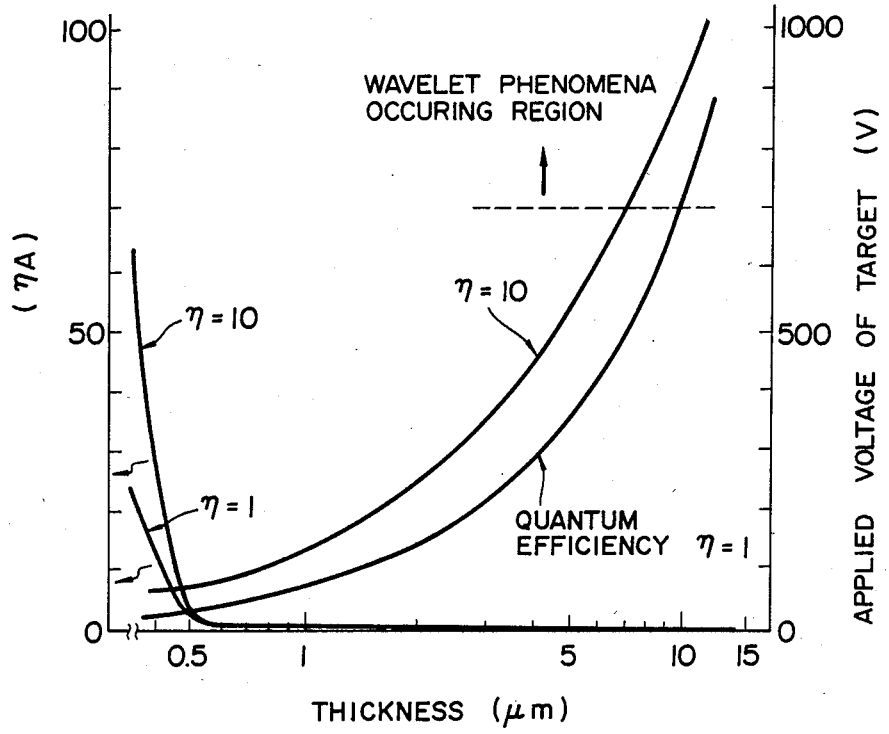

FIG. 7 shows applied target voltage which produces the gain of 1 or 10 in the target of an image pick-up tube using amorphous semiconductor layers, which mainly comprise Se and which are different each other in layer thickness, as photoconductive layers. FIG. 7 also shows the relation between the dark current and the layer thickness derived when the target voltage is applied. It is evident from FIG. 7 that the dark current abruptly increases when the layer thickness of the amorphous semiconductor layer becomes below 0.5 μm. Accordingly, the layer thickness of the amorphous layer is desired to be not less than 0.5 μm.

If the layer thickness is made large, however, the applied target voltage required to obtain a gain larger than unity also becomes high and wavelets patterns (hereafter referred to as "wavelets phenomena") tend to occur in the periphery of the screen. The abnormal phenomena tend to occur when the applied voltage is not lower than 700 V. For practical use, therefore, it is understood from FIG. 7 that the layer thickness of the amorphous semiconductor is desired to be not higher than 10 μm.

Further, a material forming hole traps in the amorphous semiconductor layer and/or another material forming electron traps may be contained in the above mentioned amorphous semiconductor to reduce the occurrence possibility of white spots. Further, the photoconductive layer need not necessarily be a single layer of amorphous semiconductor layer. The photoconductive layer may be formed by piling up two or more kinds of amorphous semiconductor layers having charge multiplication function, may be formed by a combination of a layer having the charge multiplication function and a layer having a photo carrier generation function or may be formed by piling up a crystal semiconductor and the above described amorphous semiconductor layer. The requisite is that the total layer thickness of amorphous semiconductor layers mainly comprising Se is not less than 0.5 μm and not larger than 10 μm when the layers function as charge multiplication layer.

In case an amorphous semiconductor material mainly comprising Se is used as the amorphous semiconductor layer, the limit of the incident light at the longer wavelength side capable of absorbing the incident light to generate optical carriers, i.e., electron-hole pairs is defined by the energy gap of the amorphous Se. Further, in case of amorphous Se, electron-hole pairs generated by the absorbed incident light are partly recombined to disappear before they are separated by the electric field to form a signal current. This phenomenon becomes more significant as the wavelength of the incident light becomes longer. This tendency still remains even in such a strong electric field region as to cause charge multiplication in the amorphous Se layer.

Two means described below were found to be effective in solving these problems.

Figure 8:
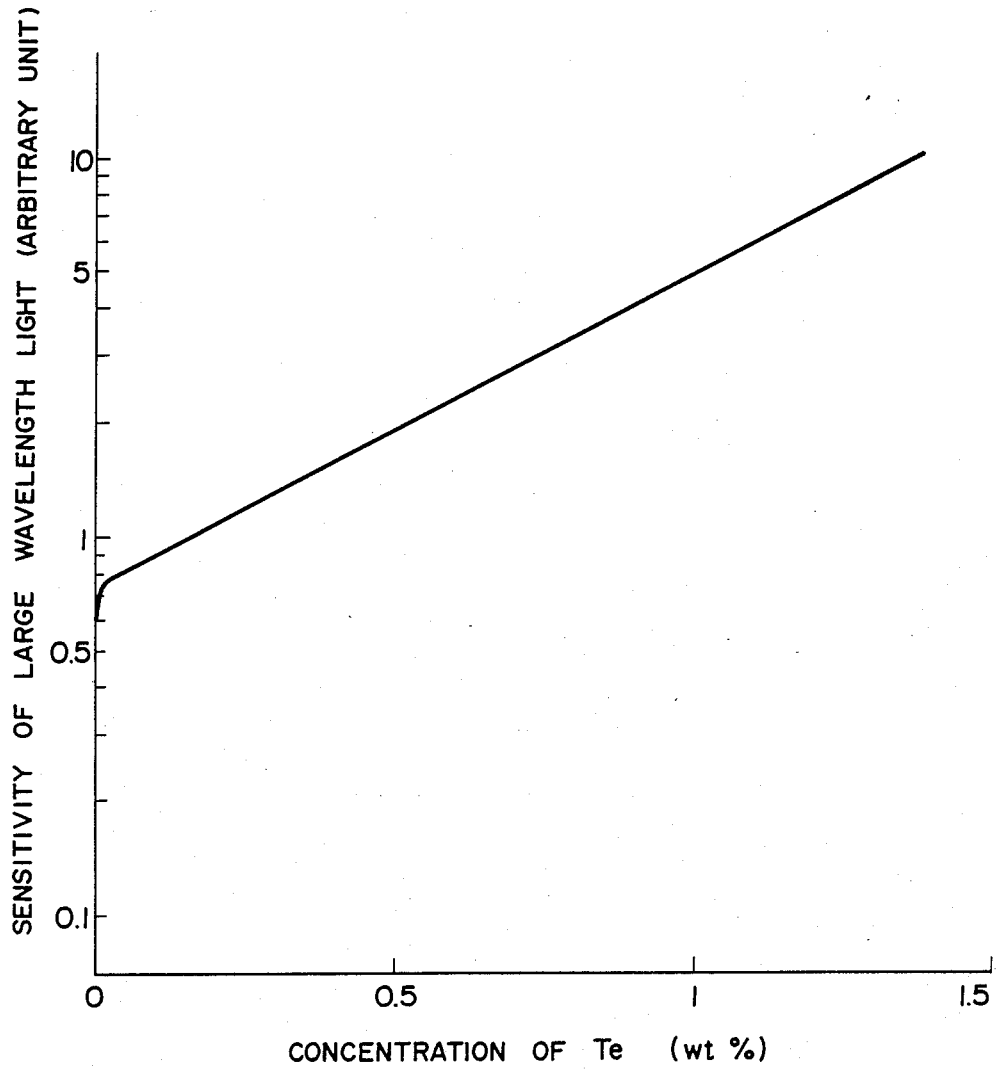

At first, the present inventors have revealed that the above described charge multiplication maintained and high sensitivity is easily obtained for long wavelength light as well when at least one out of Te, Sb, Cd and Bi is added to at least a part of the amorphous semiconductor layer mainly comprising Se. At this time, the concentration of the element added to the amorphous semiconductor layer mainly comprising Se need not be constant with respect to the layer thickness direction in the layer and may vary. FIG. 8 shows an example of the relation between the sensitivity for long wavelength light and the average additive concentration of Te obtained under an identical operation condition. As evident from FIG. 8, the sensitivity for long wavelength light is increased as the additive concentration of Te is increased. It is thus understood that addition of Te is extremely effective. The requisite is to add at least one of Te, Sb, Cd and Bi. Although the concentrations of the additives should be chosen according to the application of the image pick-up tube, the average value is desired to be not less than 0.1 weight %. If the additive concentration is too high, however, the electric field at the blocking contact part becomes strong and hence the dark current is increased, fine characteristics desirable for the image pick-up tube being not attainable. It is desirable that the average value of concentrations of additives is not larger than 50 weight %. For the purpose of obtaining stable rectifying characteristics, the above described additive is desired not to be added to a part of the electrode interface of the photoconductive layer 3 as shown in FIG. 1 at the light incidence side provided that the photoconductive layer 3 consists of only an amorphous semiconductor layer mainly comprising Se.

As the second means for solving the above described problem, the present inventors disclose means disposing a new optical carrier generation layer different from the amorphous semiconductor layer adjacent to the amorphous semiconductor layer in the photoconductive layer, instead of providing the amorphous semiconductor layer itself with both charge generation function and charge multiplication function. If the incident light is absorbed in the above described optical carrier generation layer to generate a greater part of optical carriers and those optical carriers are led to the amorphous semiconductor layer to be multiplied in the amorphous semiconductor layer, carriers disappearing in the amorphous semiconductor layer due to direct recombination of free electrons with free holes are very few. It is thus possible to solve the above described problem of degradation in efficiency caused by the recombination of optical carriers within the amorphous semiconductor layer. Owing to this means, it is possible to establish the spectrum sensitivity characteristics agreeing with the application of the image pick-up tube by selecting the material of the optical carrier generation layer according to the object.

In case of amorphous Se, for example, a uniform thin film can easily be formed on an arbitrary optical carrier generation layer by the vacuum deposition method. The photoconductive layer having amorphous Se as the charge multiplication layer is extremely effective as the target of an image pick-up tube.

If the optical carrier generation layer is disposed at this time at the transparent electrode side with respect to the amorphous Se charge multiplication layer, most of charges flowing into the amorphous Se become holes. Accordingly, it becomes unnecessary to consider noise components based upon running of electrons generated by the light. Thus, this disposition is further advantageous in low-noise multiplication.

Figure 9:
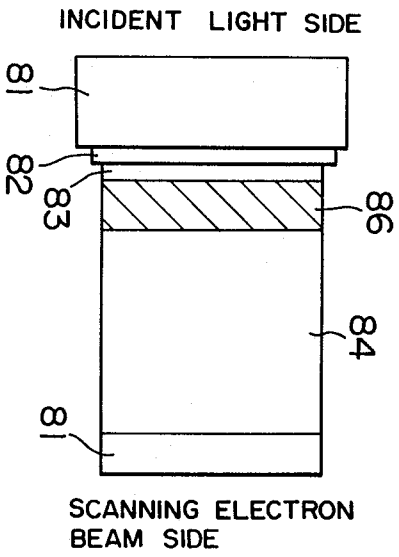
FIGS. 9 and 10 show embodiments of a photoconductive device according to the present invention.

FIG. 9 is a structure diagram showing the principle of the target in an embodiment of an image pick-up tube according to the present invention. A transparent substrate 81, a transparent electrode 82, an optical carrier generation layer 86 absorbing the light and generating charges, an amorphous semiconductor layer 84 serving as a charge multiplication layer, and an electron injection blocking layer 85 are illustrated. If rectifying contact at the interface between the transparent electrode 82 and the optical carrier generation layer 86 is not enough to prevent injection of holes from the transparent electrode 82 to the optical carrier generation layer 86, it is also effective to add an auxiliary rectifying contact layer 83 between the transparent electrode 82 and the optical carrier generation layer 86 to enhance the rectifying contact function.

It is a matter of course that the material forming the optical carrier generation layer must be large in optical absorption coefficient and photoelectric conversion efficiency. However, the material forming the optical carrier generation layer need not necessarily be an amorphous material but may be a crystal material. To be concrete, an amorphous semiconductor of chalcogenide family, an amorphous semiconductor of tetrahedral family, a compound semiconductor of III-V family, a compound semiconductor of II-VI family of their compounds, for example, can be used. In this case, it is important that the hole injection from the transparent electrode into the optical carrier generation layer is prevented under high electric field, but holes easily flow from the optical carrier generation layer into the amorphous semiconductor layer.

When carriers do not run smoothly from the optical carrier generation layer to the charge multiplication layer, it is also effective to insert an intermediate layer comprising a compound material which is different in composition from the optical carrier generation layer between the optical carrier generation layer and the charge multiplication layer to improve the carrier running property.

Figure 10:
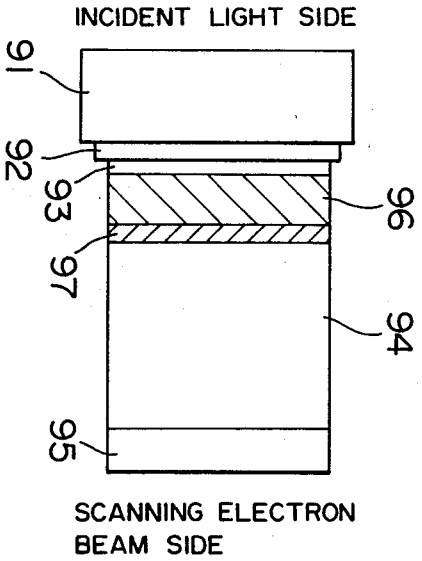

FIG. 10 is a structure diagram showing the principle of the target of an embodiment of an image pick-up tube according to the present invention. A transparent substrate 91, a transparent electrode 92, an optical carrier generation layer 96 absorbing the light and generating charges, an amorphous semiconductor layer 94 serving as a charge multiplication layer, and an electron injection blocking layer 95 are illustrated. If rectifying contact at the interface between the transparent electrode 92 and the optical carrier generation layer 96 is not enough to prevent injection of holes from the transparent electrode 92 to the optical carrier generation layer 96, it is also effective to insert an auxiliary rectifying contact layer 93 between the transparent electrode 92 and the optical carrier generation layer 96 to enhance the rectifying contact function in the same way as FIG. 9. FIG. 10 shows the position of the above described intermediate layer 97 from the viewpoint of principle.

It is effective to use as this intermediate layer a layer for charging the distribution of the electric field strength within the photoconductive layer by adding a material for changing the band gap such as bismuth, cadmium, or their chalcogenide compounds, tellurium or tin, or a material forming the negative space charge such as arsenic, germanium, antimony, indium, gallium, or their chalcogenide compounds, sulphur, chlorine, iodine, bromine, oxidized copper, indium oxide, selenium oxide, vanadium oxide (for example, vanadium pentaoxide), molybdenum oxide, tungsten oxide, gallium fluoride, or indium fluoride to an amorphous semiconductor layer mainly comprising Se, for example.

In any case, the object of the above described intermediate layer is to facilitate flow of electrons from the charge multiplication layer into the optical carrier generation layer and flow of holes from the optical carrier generation layer to the amorphous semiconductor layer under high electric field. The material forming the intermediate layer is not necessarily limited to the above described elements or additives.

For the purpose of changing the electric field strength within the photoconductive layer, it is also effective to form the intermediate layer by adding slightly a material capable of modulating the conductivity type such as an element of III or V family to an amorphous semiconductor layer composed of a tetrahedral material.

The present inventors further studied the optical carrier generation layer and found that two materials described below were suitable.

At first, it is now assumed that the first group comprises Zn, Cd, Hg and Pb, and the second group comprises O, S, Se and Te. If a combination of at least one element selected from the first group and at least one element selected from the second group is used as a main material of the carrier generation layer, high photoelectric conversion efficiency is obtained owing to the carrier generation layer. Since it is possible to adjust the optical band gap width and control the spectral sensitivity by changing the element combination and composition ratio, the above described combination is extremely excellent as the material of the above described optical carrier generation layer.

As the material of the optical carrier generation layer, a material mainly comprising at least one out of ZnS, CdS, ZnSe, CdSe, ZnTe, CdTe, HgCdTe, PbO and PbS, for example, is desirable.

Further, the target using CdSe, CdS, ZnCdTe, CdTe or the like in the optical carrier generation layer is suitable to image pick-up in the visible ray region and the near infrared ray region. The target using PbS, HgCdTe or the like is suitable to image pick-up in the infrared ray region. Further, the target using PbO or the like in the optical carrier generation layer is suitable to the X-ray image.

The optical carrier generation layer can be formed by means of vacuum evaporation under the state that the underlying substrate is heated or by means of sputtering under the presence of inert gas such as argon or reactive gas containing a component element. Further, it is possible to effect heating in gas atmosphere such as $O_2$, S, Se or Te after the optical carrier generation layer has been formed.

As a result of further study, the present inventors has found that it is possible to realize an image pick-up tube having extremely high sensitivity which has been improved with respect to the problem of degradation in efficiency due to the optical carrier recombination within the above described amorphous semiconductor layer, by replacing the layer among the photoconductive layer which absorbs the incident light and generates a greater part of optical carriers with an amorphous semiconductor mainly comprising an amorphous tetrahedral material and containing at least one of F, H and Cl and by combining the amorphous semiconductor with the charge multiplication layer.

A greater part of the incident light is absorbed inside the optical carrier generation layer comprising an amorphous tetrahedral material and generate electron-hole pairs. When an amorphous tetrahedral material containing halogen such as fluorine or chlorine, or hydrogen is used, high photoelectric conversion efficiency is obtained because the internal defect can be kept extremely low. Further, it is possible to absorb the signal light efficiently with thin layer thickness because the optical band gap width can be adjusted by means of the layer forming condition, the concentration of halogen or hydrogen, mixed crystallization with a plurality of tetrahedral materials, or the like. Above all, amorphous silicon containing hydrogen is extremely excellent as the material of the above described optical carrier generation layer, because the absorption factor for the light of the visible region is high and almost all of photons absorbed in the layer are separated into free electrons and free holes unlike amorphous Se.

In this case, the optical carrier generation layer can be formed by reactive sputtering on a tetrahedral material in the atmosphere containing halogen such as fluorine or chlorine, or hydrogen, or resolution of gas containing hydride, fluoride, or chloride of a tetrahedral element, for example.

For example, amorphous silicon containing hydrogen can be formed by using a method of keeping the underlying substrate at 100° to 300° C. and applying reactive sputtering to silicon in mixed atmosphere of inert gas and hydrogen of by using a method of resolving gas containing silicon such as monosilane or disilane with energy such as plasma discharge, light, electromagnetic wave or heat.

Further, it is also possible to obtain an amorphous silicon germanium compound having a narrower energy gap than amorphous silicon or an amorphous silicon carbon compound having a wider energy gap than amorphous silicon by sputtering silicon, germanium, or a mixture of silicon and carbide or by mixing germane containing germanium, methane containing carbon, acetylene or the like with monosilane and resolving them. It is thus possible to adjust the spectral sensitivity characteristics of an image pick-up tube.

In the same way as the foregoing case, the present invention brings about a more significant effect by inserting an intermediate layer having a varied energy band structure or varied electric field between the amorphous silicon layer and the amorphous semiconductor layer to make smooth the transfer of optical carriers from the amorphous silicon layer to the amorphous semiconductor layer.

It has also been effective to use as the intermediate layer a layer derived by adding a specific material to the above described amorphous semiconductor layer mainly comprising Se, a layer controlled in band gap and space charge by mixing a material capable of modulating the conductivity type such as III or V family including germanium, carbon, nitrogen or tin into an amorphous tetrahedral material, or a combination of the above described two layers.

As a result of study of the characteristics of a highly sensitive image pick-up tube comprising amorphous Se photoconductive layer, the present inventors found that an image remained after an object which was much brighter than usual objects, for example, an object which was ten thousand times or more in luminance had been photographed by the above described highly sensitive image pick-up tube operated with such high electric field as to cause charge multiplication. Hereafter, this phenomenon if referred to as highlight after image (HAI).

Figure 13:
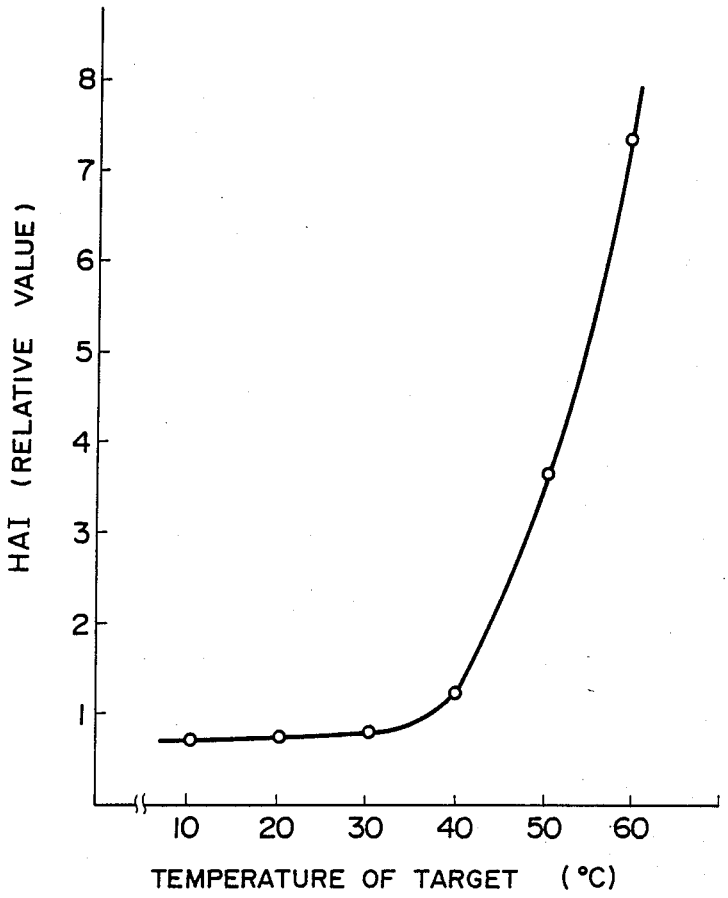
FIGS. 13, 14 and 15 are drawings for explaining the characteristics of a photoconductive device according to the present invention.

As a result of detailed study by the present inventors, it was found that the above described HAI depended upon the temperature of the target section. It was also found that the above described phenomenon could be restrained to nearly the same level as that caused when the Se image pick-up tube was operated under usual electric field and hence no problem was posed in practical use provided that the temperature of the target section was kept below 40° C. FIG. 13 shows its effect.

If the image pick-up tube having a target section as shown in FIG. 2 is operated while keeping the temperature of the target section low, the HAI can be restrained as shown in FIG. 13. If the temperature of the target is kept below about 40° C., the HAI rapidly disappears and a favorable image can be obtained as evident from FIG. 13. Even if the image pick-up tube is operated with the target temperature below about 40° C., the dark current extremely advantageously tends to reduce without hampering the charge multiplication.

If it is attempted to apply such strong electric field as to cause charge multiplication inside the above described amorphous Se to the amorphous Se, there is a fear that the photoconductive layer is destroyed by the electric field before sufficient charge multiplication effect is obtained and local screen defects tend to occur.

The present inventors studied in further detail a photoconductive device using charge multiplication in an amorphous semiconductor layer mainly comprising the above described amorphous Se. As a result, it was found that the above described problems could be significantly improved by using a metal electrode comprising at least one out of Cu, Ag, Au, Al, In, Ti, Ta, Cr, Mo, Ni and Pt as the electrode on the substrate. Further, it was found that more significant effects could be obtained by inserting a single layer of cerium oxide or laminates comprising oxide of at least one out of Ge, Zn, Cd, Al, Si, Nb, Ta, Cr and W and comprising cerium oxide between the metal electrode and the amorphous Se layer.

In case of a device structure in which the above described metal electrode is a transparent electrode and the light is applied from the substrate side to the photoconductive layer, the gain of the whole photoconductive device is reduced as much as the optical transmittivity is lowered due to the use of the semitransparent metal electrode. By using the metal electrode, however, the photoconductive device can be operated with raised electric field applied. It has thus been found that a high signal current enough to compensate the drop in gain caused by transmittivity is obtained.

In a photoconductive device other than an image pick-up tube having such a structure that the light is applied to the device from the side opposite to the substrate as well, it is a matter of course that this metal electrode may be used. In this case, however, a transparent electrode made of oxide or the like can be used as the electrode opposite to the substrate. It is thus not necessary to consider the drop in gain of the whole photoconductive device caused by the optical transmittivity of the above described electrode disposed on the substrate. The requisite is that the electrode of the substrate side is formed by the above described metal material whether the optical transmittivity may be large or not. Further, the metal electrode of the present invention need not be simply a uniform electrode. Depending upon the application, the metal electrode may have any shape such as comb, rattan blind or island.

Figure 14:
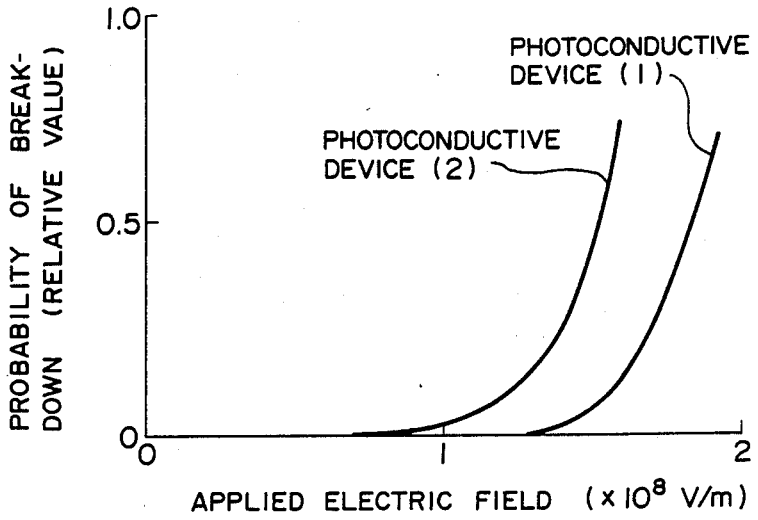

FIG. 14 shows the relation between the probability of device breakdown and the applied electric field of photoconductive devices (1) and (2) when electric field is applied to them. In FIG. 12, the photoconductive device (1) comprises transparent glass as a substrate 111, a semitransparent Ta thin film as an electrode 112, a $GeO_2$ thin film as a hole injection blocking layer 113, amorphous Se as an amorphous semiconductor layer 114, and Au as a pairing electrode 118. The photoconductive device (2) uses a transparent conductive layer mainly comprising $SnO_2$ as the electrode 112. Other components of the photoconductive device (2) are the same as those of the photoconductive device (1). It is evident from FIG. 14 that the photoconductive device (1) according to the present invention using a metal thin film as the electrode can be operated with higher electric field. Accordingly, it is understood that the photoconductive device (1) has higher sensitivity.

Figure 15:
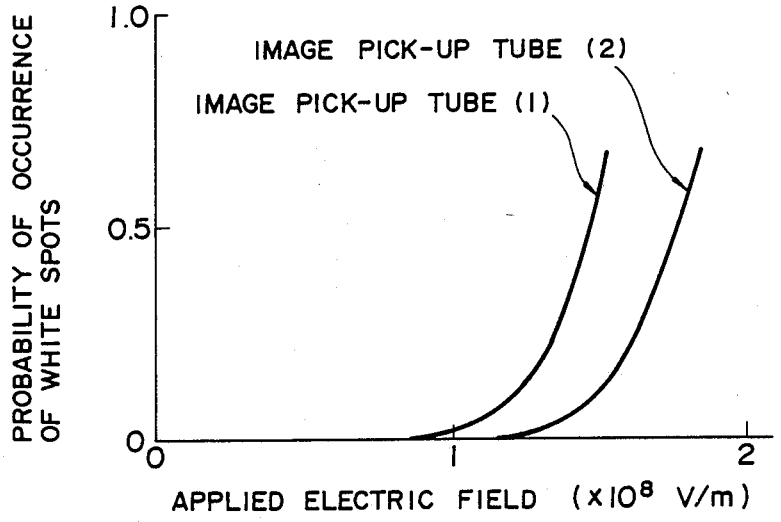

FIG. 15 is a drawing for illustrating the effect in case of the image pick-up tube and shows the relation between the probability of occurrence of white spots and the applied electric field for a target section (1) of an image pick-up tube and a target section (2) of an image pick-up tube. The target section (1) uses a semitransparent Cr metal thin film as the electrode 2 of FIG. 1. The target section (2) uses a transparent conductive film mainly comprising $In_2O_3$ as the electrode 2 of FIG. 1. In this case as well, the target section of the present invention can be operated with higher electric field while restraining the screen defects. Accordingly, it is understood that the image pick-up tube of the present invention has higher sensitivity.

By using a metal electrode as the electrode on the substrate, it is thus possible to realize a photoconductive device capable of undergoing higher electric field and having a higher signal amplification factor.

The photoconductive device according to the present invention has heretofore been described together with various modes mainly by taking the image pick-up as examples. However, it is a matter of course that the present invention can be embodied under a combination of the above described modes. As already described, the present invention can be embodied as photoconductive devices of photocells, solid-state image pick-up devices such as one or two dimensional image sensors, or the like. Further, it is a matter of course that those photoconductive devices can be operated by an operation method of photoconductive devices according to the present invention.

Figure 11:
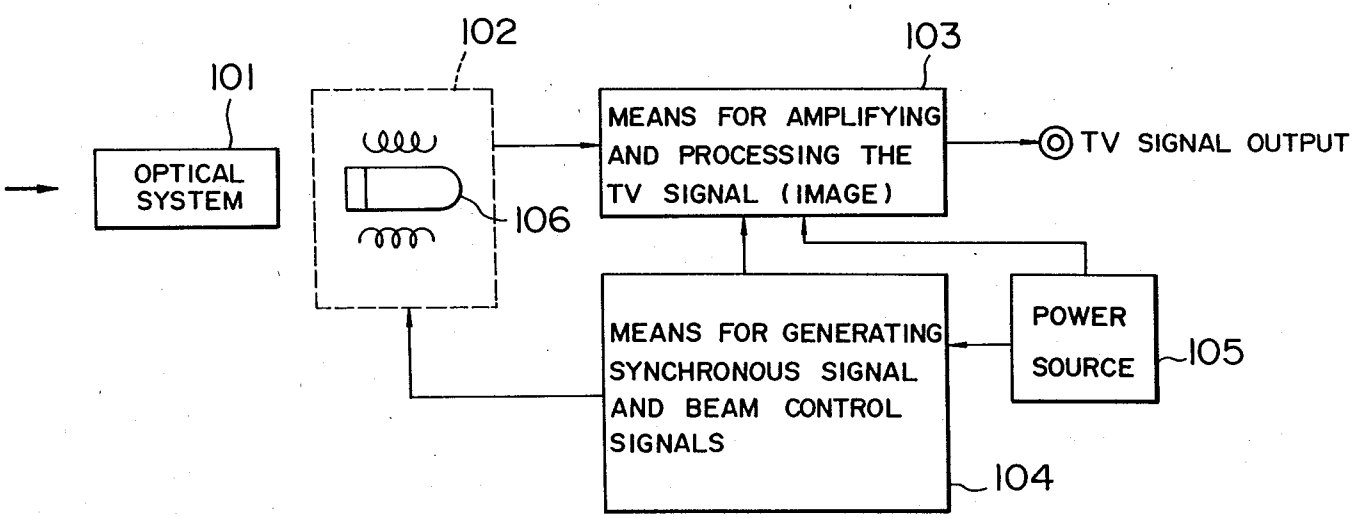
FIG. 11 shows an example of the basic configuration of a camera using a photoconductive device according to the present invention.

FIG. 11 shows an example of configuration of a monochrome camera using a photoconductive device according to the present invention. As shown in FIG. 11, the camera comprises an optical system 101 for forming the optical image, a coil assembly 102 including a coil for deflecting and focusing the electron beam and an image pick-up tube, a circuit section 103 for forming a TV signal current supplied from the coil assembly and converting the TV signal current into a TV signal conforming to predetermined standards for processing, a circuit section 104 for generating synchronization signals and including a deflection and amplification circuit for deflecting the electron beam, and a power source section 105.

In case of a three-tube color camera, the circuit of FIG. 11 is disposed for each of three colors R, G and B to form a parallel circuit, and a circuit section for processing the chrominance is added as well known. By applying the present invention to cameras having basic configuration as shown in FIG. 11, it is possible to not only realize TV images of high precision but also develop wide variety of new TV media.

The photoconductive device according to the present invention and its operation method will now be described in detail by referring to some concrete examples.

Examples 3 to 47 show examples where the present invention is applied to image pick-up tubes. The structure of the image pick-up tube has already been shown in FIG. 1.

EXAMPLE 1

A Cr semitransparent electrode having thickness of 0.01 μm is formed on a quartz substrate by using the electron beam evaporation technique. On that Cr semitransparent electrode, a $GeO_2$ thin layer and a $CeO_2$ thin layer having total layer thickness of 0.03 μm are deposited by the evaporation technique to form a hole injection blocking layer. Further thereon, an amorphous semiconductor layer comprising Se, As and Te is formed to have thickness of 0.5 to 10 μm by the evaporation technique. Further thereon, an Al electrode having layer thickness of 0.3 μm is deposited by using the evaporation technique. As a result, a photocell is obtained.

EXAMPLE 2

A metal electrode having layer thickness of 0.2 μm and mainly comprising Au is formed on a semiinsulative semiconductor substrate by the evaporation technique. Amorphous Se is formed thereon to have thickness of 0.5 to 10 μm by the evaporation technique. Further thereon, $CeO_2$ is deposited to have thickness of 0.03 μm as a hole injection blocking layer by using the evaporation technique. Further thereon, a transparent electrode having thickness of 0.1 μm and mainly comprising $In_2O_3$ is formed by using the low temperature sputtering temperature. As a result, a solid-state image pick-up device is obtained.

EXAMPLE 3

A semi-transparent Ta electrode having layer thickness of 0.01 μm is formed on a glass substrate by the sputtering technique. Thereon $CeO_2$ is deposited to have thickness of 0.03 μm as the hole injection blocking layer by the evaporation technique. Thereon amorphous Se is formed to have thickness of 0.5 to 6 μm by the evaporation technique. Further thereon, $Sb_2S_3$ is resistance-heated and evaporated in inert gas atmosphere of $2\times10^{-1}$ Torr to have thickness of 0.1 μm as the electron injection blocking layer. A photoconductive target of image pick-up tube having a blocking type structure is thus obtained. This target is incorporated into a casing of image pick-up tube containing an electron gun therein, resulting in a photoconductive image pick-up tube.

The photoconductive devices of the above described EXAMPLES 1, 2 and 3 are operated in electric field not less than $8\times10^7$ V/m. For example, high sensitivity with gain not less than 10 is attained in the electric field of $1.3\times10^8$ V/m.

EXAMPLE 4

A transparent electrode mainly comprising tin oxide is formed on a glass substrate. On this transparent electrode, amorphous Se is vacuum-evaporated to form an amorphous semiconductor layer having thickness of 0.1 to 6 μm. On the amorphous Se, $Sb_2S_3$ is evaporated in the inert gas atmosphere of $2\times10^{-1}$ Torr to have thickness of 1,000 Å as the electron injection blocking layer. The target section of a photoconductive image pick-up tube having a blocking type structure is thus obtained.

EXAMPLE 5

On a glass substrate, a transparent electrode mainly comprising indium oxide is formed. On this transparent electrode, an amorphous semiconductor layer comprising Se and As or Se and Ge and having thickness of 0.1 to 6 μm is formed by the vacuum evaporation technique. When the layer is formed, Se and $As_2Se_3$ or Se and Ge are simultaneously evaporated on the substrate respectively different from boats so that the concentration of As or Ge will be 2 weight % on the average. On that layer, $Sb_2S_3$ is evaporated in the inert gas atmosphere of $1\times10^{-1}$ Torr to have thickness of 800 Å as the electron injection blocking layer. The target section of a photoconductive image pick-up tube having a blocking type structure is thus obtained.

EXAMPLE 6

A transparent electrode mainly comprising indium oxide is formed on a glass substrate. Thereon, an amorphous semiconductor layer comprising Se, As and Ge and having layer thickness of 0.5 to 6 μm is formed. When the layer is formed, Se, $As_2Se_3$ and GeSe are simultaneously evaporated onto the substrate respectively from different boats so that the total amount of As and Se will become 3 weight % on the average. Further thereon, $Sb_2S_3$ is evaporated in the ineart gas atmosphere of $2\times10^{-1}$ Torr to have thickness of 800 Å as the electron injection blocking layer. As a result, the target section of a photoconductive image pick-up tube having a blocking type structure is obtained.

The target section of the image pick-up tube derived by the above described EXAMPLES 4, 5 and 6 is incorporated into a casing of the image pick-up tube containing an electron gun, resulting in a photoconductive image pick-up tube. When the resultant image pick-up tube is operated in the target electric field not less than $8\times10^7$ V/m, the signal is amplified within the amorphous semiconductor layer. When the electric field has a value of $1.2\times10^8$ V/m, for example, the output is obtained with a gain close to 10.

In the above described EXAMPLES 4, 5 and 6, a vacuum-evaporated layer of cerium oxide having thickness of 300 Å, for example, may be inserted between the transparent electrode and the amorphous semiconductor layer as an auxiliary rectifying contact layer. In this case, the function of blocking injection of holes from the transparent electrode is enhanced. Accordingly, operation in higher electric field strength becomes possible and the sensitivity with charge multiplication factor not lower than 10 is obtained.

EXAMPLE 7

A transparent electrode mainly comprising tin oxide is formed on a glass substrate. On this transparent electrode, an amorphous Se layer is evaporated to form an amorphous semiconductor layer having thickness of 1 to 3 μm by the evaporation technique. On the amorphous semiconductor layer, $Sb_2S_3$ is evaporated in the inert gas atmosphere of $2\times10^{-1}$ Torr to have thickness of 0.1 μm as the electron injection blocking layer. The target section of a photoconductive image pick-up tube having a blocking type structure is thus obtained.

EXAMPLE 8

A transparent electrode mainly comprising indium oxide is formed on a glass substrate. On this transparent electrode, $CeO_2$ is evaporated to have thickness of 0.03 μm. Further thereon, an amorphous Se layer having layer thickness of 0.5 to 2 μm is formed by the vacuum evaporation technique, resulting in an amorphous semiconductor layer. On the amorphous semiconductor layer, $Sb_2S_3$ is evaporated in the inert gas atmosphere of $1\times10^{-1}$ Torr to have thickness of 0.1 μm as the electron injection blocking layer. The target section of a photoconductive image pick-up tube having a blocking type structure is thus obtained.

EXAMPLE 9

A transparent electrode mainly comprising tin oxide is formed on a glass substrate. On this transparent electrode, $GeO_2$ and $CeO_2$ are successively evaporated to have thickness of 0.015 μm respectively. Further thereon, an amorphous Se layer having thickness of 0.02 to 0.06 μm is also formed by using the vacuum evaporation technique. Succeedingly, Se and LiF are evaporated from respective boats to form an amorphous layer having thickness of 0.02 to 0.06 μm. At this time, the concentration of LiF is defined to be 4,000 weight ppm and distributed uniformly in the layer thickness direction. Further thereon, an amorphous Se layer is so formed by the vacuum evaporation method that the total layer thickness will be 1 to 8 μm. On the amorphous Se layer, $Sb_2S_3$ is evaporated in the inert gas atmosphere of $2\times10^{-1}$ Torr to have thickness of 0.1 μm as the electron injection blocking layer. The target section of a photoconductive image pick-up tube having a blocking type structure is thus obtained.

EXAMPLE 10

A transparent electrode mainly comprising indium oxide is formed on a glass substrate. On that transparent electrode, $CeO_2$ is evaporated to have thickness of 0.03 μm. Further thereon, an amorphous semiconductor layer comprising Se, As and LiF and having layer thickness of 0.02 to 0.04 μm is formed by the vacuum evaporation technique. When the layer is formed, Se, $As_2Se_3$ and LiF are simultaneously so evaporated from respective different boats that the concentration of As will be 3 to 6 weight % and the concentration of LiF will be 3,000 to 6,000 weight ppm on the average. Further thereon, an amorphous semiconductor layer comprising Se, As and LiF and having layer thickness of 0.03 to 0.045 μm is formed by the vacuum evaporation technique. At this time, the concentration of As is defined to be 2 to 5 weight % and the concentration of Li is defined to be 15,000 weight ppm on the average. Further thereon, an amorphous semiconductor layer comprising Se and As is so formed by the vacuum evaporation technique that the total layer thickness will be 1 to 4 μm. At this time, the concentration of As is defined to be 1 to 3 weight %. Further thereon, $Sb_2S_3$ is evaporated in the inert gas atmosphere of $1\times10^{-1}$ Torr to have thickness of 0.1 μm as the electron injection blocking layer. The target section of a photoconductive image pick-up tube having a blocking type structure is thus obtained.

EXAMPLE 11

A transparent electrode mainly comprising indium oxide is formed on a glass substrate. On that transparent electrode, an amorphous semiconductor layer comprising Se and LiF and having layer thickness of 0.02 to 0.03 μm is formed by the vacuum evaporation technique. When the layer is formed, Se and LiF are simultaneously so evaporated from respective different boats that the concentration of LiF will be 2,000 weight ppm on the average. Further thereon, an amorphous semiconductor layer comprising Se and LiF and having layer thickness of 0.03 to 0.04 μm is formed by the vacuum evaporation technique. The concentration of LiF at this time is made to be 8,000 to 15,000 weight ppm on the average. Further, Se and Te are evaporated from respective different boats to form an amorphous semiconductor layer having layer thickness of 0.02 to 0.04 μm. At this time, the concentration of Te is defined to be 5 to 15 weight %. Succeedingly, such an amorphous Se layer is so formed by the vacuum evaporation technique that the total layer thickness will be 1 to 4 μm. Further thereon, $Sb_2S_3$ is evaporated in the inert gas atmosphere of $2\times10^{-1}$ Torr to have thickness of 0.08 μm as the electron injection blocking layer. The target section of a photoconductive image pick-up tube having a blocking type structure is thus obtained.

The target section of an image pick-up tube derived by the EXAMPLES 7, 8, 9, 10 and 11 is incorporated into the casing of the image pick-up tube containing an electron gun therein, resulting in a photoconductive image pick-up tube. When the resultant image pick-up tube is operated in the electric field not less than $7\times10^7$ V/m, the signal is amplified within the amorphous photoconductive layer. When the electric field has a value of $1.2\times10^8$ V/m for a target having layer thickness of 2 μm, for example, the output has been obtained with a gain larger than 10.

EXAMPLE 12

A transparent electrode mainly comprising tin oxide is formed on a glass substrate. On this transparent electrode, Se and Te are vacuum-deposited from respective different boats to have thickness of 1 to 2 μm. At this time, the concentration of Te is defined to be 0.01 weight % and distributed uniformly in the layer thickness direction. On this amorphous semiconductor layer mainly comprising Se, $Sb_2S_3$ is evaporated in the inert gas atmosphere of $2\times10^{-1}$ Torr to have thickness of 0.1 μm as the electron injection blocking layer. The target section of a photoconductive image pick-up tube having a blocking type structure is thus obtained.

EXAMPLE 13

A transparent electrode mainly comprising tin oxide is formed on a glass substrate. On this transparent electrode, Se and Te are vacuum-evaporated from respective different boats to have thickness of 1 to 3 μm. The concentration of Te is defined to be 0 weight % at the start of evaporation and gradually increased with the advance of evaporation so that the average concentration of the whole layer will be 0.1 weight %. On this photoconductive layer, $Sb_2S_3$ is evaporated in the inert gas atmosphere of $2\times10^{-1}$ Torr to have thickness of 0.1 μm. The target section of a photoconductive image pick-up tube having a blocking type structure is thus obtained.

EXAMPLE 14

A transparent electrode mainly comprising indium oxide is formed on a glass substrate. On this transparent electrode, a layer comprising Se and As, or Se and Ge and having layer thickness of 0.01 to 1 μm is formed by the vacuum evaporation technique. When the layer is formed, Se and $As_2Se_3$, or Se and Ge are simultaneously evaporated from respective boats and deposited so that the concentration of As or Ge will be 3 weight % on the average. Subsequently, a layer comprising Se and Te or Sb, and As or Ge and having layer thickness of 0.01 to 0.06 μm is formed by the vacuum evaporation technique. When the layer is formed, Se, Te or Sb, and $As_2Se_3$ or Ge are simultaneously evaporated from respective boats and deposited so that concentration of Te or Sb will be 10 to 15 weight % on the average and the concentration of As or Ge will be 2 weight % on the average. Further, a layer comprising Se and As, or Se and Ge is so formed by the vacuum evaporation technique that the thickness of the whole layer will be 2 to 3 μm. When the layer is formed, Se and $As_2Se_3$, or Se and Ge are simultaneously evaporated from respective different boats and deposited so that the concentration of As or Ge will be 2 weight % on the average. Further thereon, $Sb_2S_3$ is evaporated in the inert gas atmosphere of $1\times10^{-1}$ Torr to have thickness of 0.08 μm as the electron charge blocking layer. The target section of a photoconductive image pick-up tube having a blocking type structure is thus obtained.

EXAMPLE 15

A transparent electrode mainly comprising indium oxide is formed on a glass substrate. On the transparent electrode, a layer comprising Se, As and Ge and having layer thickness of 0.05 to 1 μm is formed. When the layer is formed, Se, $As_2Se_3$ and Ge are simultaneously evaporated from respective different boats and deposited so that the total concentration of As and Ge will be 3 weight % on the average. This is referred to as the first layer. Subsequently on the first layer, a layer comprising Se, As and at least one out of Te, Sb, Cd and Bi and having layer thickness of 0.01 to 0.06 μm is formed as the second layer by the vacuum evaporation technique. When the layer is formed, Se, $As_2Se_3$, and at least one out of Te, Sb, Cd and Bi, are simultaneously evaporated from respective different boats and deposited. The concentration of Te, Sb, Cd and Bi within the second layer is varied in the layer thickness direction. The concentration of the second layer at the start of evaporation is defined to be 0 weight % and gradually increased with the advance of evaporation. The concentration at the intermediate time of the evaporation of the second layer is made to assume the maximum value. Thereafter, the concentration gradually decreases. When the evaporation of the second layer is finished, the concentration assumes the value of 0 weight % again. At this time, the concentration of As within the second layer is made to be 2 weight % on the average. And the total concentration of one or more out of Te, Sb, Cd and Bi is made to be 15 to 45 weight % on the average of the second layer. Evaporation of the second layer is thus finished. On the second layer, a layer comprising Se and As, or Se and Ge is formed as the third layer by the vacuum evaporation technique so that the thickness of the whole layer will be 2 to 3 μm. When the layer is formed, Se and $As_2Se_3$ or Ge are simultaneously evaporated from respective different boats and deposited so that the concentration of As or Ge will be 2 weight % on the average. Further thereon, $Sb_2S_3$ is evaporated in the inert gas atmosphere of $2\times10^{-1}$ Torr to have thickness of 0.08 μm as the electron injection blocking layer. The target section of a photoconductive image pick-up tube having a blocking type structure is thus obtained.

The target section of an image pick-up tube derived by the above described EXAMPLES 12, 13, 14 and 15 is incorporated into the casing of the image pick-up tube containing an electron gun therein, resulting in a photoconductive image pick-up tube. When the resultant image pick-up tube is operated in the target electric field not less than $8\times10^7$ V/m, the signal is amplified in the amorphous semiconductor layer. When the target electric field has a value of $1.2\times10^8$ V/m, for example, the output with quantum efficiency not less than 10 is obtained.

In the above described EXAMPLES 12, 13, 14 and 15, it is also possible to insert a vacuum evaporation layer comprising cerium and having layer thickness of 0.03 μm, for example, as the auxiliary rectifying contact layer between the transparent electrode and the amorphous semiconductor layer. In this case, the function of blocking injection of holes from the transparent electrode is enhanced. Accordingly, operation in higher electric field becomes possible and higher sensitivity can be realized.

EXAMPLE 16

A transparent electrode mainly comprising tin oxide is formed on a glass substrate. On this transparent electrode, Se and LiF are evaporated from respective different boats and vacuum-deposited to have thickness of 1 to 6 μm. At this time, the concentration of LiF is defined to be 500 weight ppm and distributed uniformly in the layer thickness direction. Further thereon, $Sb_2S_3$ is evaporated in the inert gas atmosphere of $2\times10^{-1}$ Torr to have thickness of 0.1 μm as the electron injection blocking layer. The target section of a photoconductive image pick-up tube having a blocking type structure is thus obtained.

EXAMPLE 17

A transparent electrode mainly comprising indium oxide is formed on a glass substrate. On this transparent electrode, a layer comprising Se and $CaF_2$ and having layer thickness of 0.01 to 0.045 μm is formed by the vacuum evaporation technique. When the layer is formed, Se and $CaF_2$ are simultaneously evaporated from respective different boats and deposited onto the substrate so that the concentration of $CaF_2$ will be 3,000 weight ppm on the average. Further thereon, Se is evaporated so that the thickness of whole layer will be 1 to 6 μm. Further thereon, $Sb_2S_3$ is evaporated in the inert gas atmosphere of $1\times10^{-1}$ Torr to have thickness of 0.1 μm as the electron injection blocking layer. The target section of a photoconductive image pick-up tube having a blocking type structure is thus obtained.

EXAMPLE 18

A transparent electrode mainly comprising tin oxide is formed on a glass electrode. On this transparent electrode, Se is vapor-deposited to have thickness of 0.02 to 0.06 μm. Subsequently, Se and KF are evaporated from respective different boats and vacuum-deposited to have thickness of 0.02 to 0.06 μm. At this time, the concentration of KF is defined to be 500 weight ppm and distributed uniformly in the layer thickness direction. Further thereon, a Se layer is formed by using the vacuum evaporation technique so that the thickness of the whole layer will be 1 to 3 μm. On the Se layer, $Sb_2S_3$ is evaporated in the inert gas atmosphere of $2\times10^{-1}$ Torr to have thickness of 0.1 μm as the electron injection blocking layer. The target section of a photoconductive image pick-up tube having a blocking type structure is thus obtained.

EXAMPLE 19

A transparent electrode mainly comprising indium oxide is formed on a glass substrate. On this transparent electrode, a layer comprising Se, As and LiF and having thickness of 0.01 to 0.045 μm is formed by the vacuum evaporation technique. When the layer is formed, Se, $As_2Se_3$ and LiF are simultaneously evaporated from respective different boats and vapor-deposited so that the concentration of As will be 3 to 6 weight % and the concentration of LiF will be 2,000 to 6,000 weight ppm on the average. Further thereon, a layer comprising Se, As and LiF and having thickness of 0.03 to 0.045 μm is formed by using the vacuum evaporation technique. At this time, the concentration of As is defined to be 2 to 3.5 weight % and the concentration of LiF is defined to be 10,000 weight ppm on the average. Further thereon, Se and As are vacuum-evaporated so that the thickness of the whole layer will be 1 to 4 μm. At this time, the concentration of As is defined to be 1 to 3 weight %. Further thereon, $Sb_2S_3$ is evaporated in the inert gas atmosphere of $1\times10^{-1}$ Torr to have thickness of 0.1 μm as the electron injection blocking layer. The target section of a photoconductive image pick-up tube having a blocking type structure is thus obtained.

EXAMPLE 20

A transparent electrode mainly comprising indium oxide is formed on a glass substrate. On that transparent electrode, a layer comprising Se and LiF and having layer thickness of 0.01 to 0.015 μm is formed by the vacuum evaporation technique. When the layer is formed, Se and LiF are simultaneously evaporated from respective different boats and vapor-deposited so that the concentration of LiF will be 3,000 weight ppm on the average. Further thereon, a layer comprising Se and LiF and having layer thickness of 0.03 to 0.045 μm is formed by using the vacuum evaporation technique. The concentration of LiF at this time is defined to be 8,000 to 15,000 weight ppm on the average. Further, Se and Te are evaporated from respective different boats to form a layer having a layer thickness of 0.02 to 0.05 μm. At this time, the concentration of Te is defined to be 5 to 15 weight %. Succeedingly, Se is evaporated so that the thickness of the whole layer will be 1 to 4 μm. Further thereon, $Sb_2S_3$ is evaporated in the inert gas atmosphere of $2\times10^{-1}$ Torr to have thickness of 0.08 μm as the electron injection blocking layer. The target section of a photoconductive image pick-up tube having a blocking type structure is thus obtained.

The target of the image pick-up tube derived by the above described EXAMPLES 16, 17, 18, 19 and 20 is incorporated into the casing of the image pick-up tube containing an electron gun therein, resulting in a photoconductive image pick-up tube. When the resultant image pick-up tube is operated in the electric field not less than $8\times10^7$ V/m, the signal is amplified in the amorphous photoconductive layer. When the electric field has a value of $1.2\times10^8$ V/m, for example, the output with the quantum efficiency not less than 10 has been obtained.

In the EXAMPLES 16, 17, 18, 19 and 20, it is also possible to insert a vacuum-evaporated layer comprising cerium oxide and having layer thickness of 0.03 μm, for example, as the auxiliary rectifying function layer between the transparent electrode and the amorphous semiconductor layer. In this case, the function of blocking injection of holes from the transparent electrode is further enhanced, resulting in operation in higher electric field and higher sensitivity.

EXAMPLE 21

A transparent electrode mainly comprising tin oxide is formed on a glass electrode. On this transparent electrode, an amorphous Se semiconductor layer is formed by using the vacuum evaporation technique.

Further thereon, Se and $SeO_2$ are evaporated from respective different boats and vacuum-deposited to have thickness of 0.02 to 0.06 μm. At this time, the concentration of $SeO_2$ is defined to be 2,500 ppm and distributed uniformly in the layer thickness direction. Further thereon, Se is evaporated to have thickness of 0.05 to 0.06 μm so that the entire layer thickness of the above described amorphous semiconductor layer mainly comprising Se will be 1 to 6 μm. Further thereon, $Sb_2S_3$ is evaporated in the inert gas atmosphere of $2\times10^{-1}$ Torr to have thickness of 0.1 μm as the electron injection blocking layer. The target section of a photoconductive image pick-up tube having a blocking type structure is thus obtained.

EXAMPLE 22

A transparent electrode mainly comprising tin oxide is formed on a glass substrate. On this transparent electrode, an amorphous Se semiconductor layer is formed by using the vacuum evaporation technique. Further thereon, $As_2Se_3$ and $GaF_3$ are evaporated from respective different boats and vacuum-deposited to have thickness of 0.03 to 0.06 μm. At this time, the concentration of $GaF_3$ is defined to be 2,000 ppm and distributed uniformly in the layer thickness direction. The thickness of the entire amorphous semiconductor layer is made to have a value of 1 to 6 μm. Further thereon, $Sb_2S_3$ is evaporated in the inert gas atmosphere of $2\times10^{-1}$ Torr to have thickness of 0.1 μm as the electron injection blocking layer. The target section of a photoconductive image pick-up tube having a blocking type structure is thus obtained.

EXAMPLE 23

A transparent electrode mainly comprising indium oxide is formed on a glass substrate. On this transparent electrode, a layer comprising Se and $CaF_2$ and having layer thickness of 0.01 to 0.05 μm is formed by using the vacuum evaporation technique. When the layer is formed, Se and $CaF_2$ are simultaneously evaporated from respective different boats and vapor-deposited so that the concentration of $CaF_2$ will be 6,000 ppm on the average. Further thereon, an amorphous Se layer is formed by the vacuum evaporation technique. Succeedingly, $As_2Se_3$ is evaporated from a boat and vacuum deposited to have thickness of 0.03 to 0.06 μm. Further thereon, Se and $GaF_3$ are evaporated from respective different boats and vacuum-deposited to have thickness of 0.02 to 0.06 μm. At this time, the concentration of $GaF_3$ is defined to be 4,000 ppm and distributed uniformly in the layer thickness direction. The thickness of the whole amorphous semiconductor layer mainly comprising Se is made to be 1 to 6 μm. Further thereon, $Sb_2S_3$ is evaporated in the inert gas atmosphere of $1\times10^{-1}$ Torr to have thickness of 0.08 μm as the electron injection blocking layer. The target section of a photoconductive image pick-up tube having a blocking type structure is thus obtained.

EXAMPLE 24

A transparent electrode mainly comprising indium oxide is formed on a glass substrate. On this transparent electrode, a layer comprising Se, As and LiF and having layer thickness of 0.01 to 0.06 μm is formed by the vacuum evaporation technique. When the layer is formed, Se, $As_2Se_3$ and LiF are simultaneously evaporated from respective different boats and deposited so that the concentration of As will be 3 to 6 weight % and the concentration of LiF will be 3,000 to 6,000 ppm on the average. Further thereon, a layer comprising Se, As and LiF and having layer thickness of 0.03 to 0.05 μm is formed by the vacuum evaporation technique. The concentration of As at this time is defined to be 2 to 3.5 weight % and the concentration of LiF is defined to be 15,000 ppm on the average. Further thereon, Se and $As_2Se_3$ are simultaneously evaporated from respective different boats to form an amorphous semiconductor layer having As concentration of 1 to 3 weight %. Further thereon, $As_2Se_3$ and $In_2O_3$ are evaporated from respective different boats and vacuum-deposited to have thickness of 0.01 to 0.1 μm. At this time, the concentration of $In_2O_3$ is defined to be 700 ppm and distributed uniformly in the layer thickness direction. Further thereon, Se and $As_2Se_3$ are simultaneously evaporated from respective different boats and vapor-deposited to have thickness of 0.01 to 0.06 μm. The concentration of As at this time is defined to be 1 to 3 weight %. The layer thickness of the whole amorphous semiconductor layer mainly comprising Se is defined to be 1 to 6 μm. Further thereon, $Sb_2S_3$ is evaporated in the inert gas atmosphere of $1\times10^{-1}$ Torr to have thickness of 0.08 μm. The target section of a photoconductive image pick-up tube having a blocking type structure is thus obtained.

EXAMPLE 25

A transparent electrode mainly comprising indium oxide is formed on a glass substrate. On the transparent electrode, a layer comprising Se and LiF and having layer thickness of 0.03 to 0.06 μm is formed by the vacuum evaporation technique. When the layer is formed, Se and LiF are simultaneously evaporated from respective different boats and deposited so that the concentration of LiF will be 4,000 ppm on the average. Further thereon, a layer comprising Se and LiF and having layer thickness of 0.03 to 0.05 μm is formed by using the vacuum evaporation technique. The concentration of LiF at this time is defined to be 8,000 to 10,000 ppm on the average. Further, Se and Te are evaporated from respective different boats to form a layer having layer thickness of 0.02 to 0.06 μm. At this time, the concentration of Te is defined to be 5 to 15 weight %. Further thereon, an amorphous Se layer is formed by using the vacuum evaporation technique. Further thereon, $As_2Se_3$ and $In_2O_3$ are evaporated from respective different boats and vacuum-deposited to have thickness of 0.03 to 0.09 μm. At this time, the concentration of $In_2O_3$ is defined to be 500 ppm and distributed uniformly in the layer thickness direction. Subsequently, Se and $In_2O_3$ are evaporated from respective different boats and vacuum-deposited to have thickness of 0.02 to 0.2 μm. At this time, the concentration of $In_2O_3$ is defined to be 1,000 ppm and distributed uniformly in the layer thickness direction. The thickness of the whole amorphous semiconductor layer mainly comprising Se is defined to be 1 to 6 μm. Further thereon, $Sb_2S_3$ is evaporated in the inert gas atmosphere of $2\times10^{-1}$ Torr to have thickness of 0.1 μm as the electron injection blocking layer. The target section of a photoconductive image pick-up tube having a blocking type structure is thus obtained.

The target of the image pick-up tube derived by the EXAMPLE 21, 22, 23, 24 or 25 is incorporated into the casing of the image pick-up tube containing an electron gun, resulting in a photoconductive image pick-up tube. When the resultant image pick-up tube is operated in electric field not less than $8\times10^7$ V/m, the signal is amplified in the amorphous semiconductor layer. When the electric field has a value of $1.2\times10^8$ V/m, for example, the output with the quantum efficiency not less than 10 is obtained.

In the EXAMPLES 21, 22, 23, 24 and 25, it is also possible to insert a vacuum-evaporated layer comprising cerium oxide and having layer thickness of 0.03 μm, for example, as the auxiliary rectifying function layer between the transparent electrode and the amorphous semiconductor layer. In this case, the function of blocking injection of holes from the transparent electrode is further enhanced. Accordingly, operation in higher electric field becomes possible, and the charge multiplication factor can be further increased.

EXAMPLE 26

A transparent electrode mainly comprising indium oxide is formed on a glass substrate. On the transparent electrode, an amorphous semiconductor of chalcogenide family, an amorphous semiconductor of tetrahedral family, a compound semiconductor of III-V family, or a compound semiconductor of II-VI family is formed as the optical carrier generation layer having layer thickness of 0.01 to 1 μm. Further thereon, amorphous Se is vacuum-deposited to have thickness of 0.05 to 6 μm. On the amorphous Se layer, $Sb_2S_3$ is evaporated in the inert gas atmosphere of $2\times10^{-1}$ Torr to have thickness of 1,000 Å as the electron injection blocking layer. The target section of a photoconductive image pick-up tube having a blocking type structure is thus obtained.

EXAMPLE 27

A transparent electrode mainly comprising indium oxide is formed on a glass substrate. On this transparent electrode, the same optical carrier generation layer as that of the EXAMPLE 26 is disposed. Further thereon, an amorphous semiconductor layer comprising amorphous Se and As, or Se and Ge and having layer thickness of 0.05 to 6 μm is vacuum-evaporated. On the amorphous semiconductor layer, $Sb_2S_3$ is evaporated in the inert gas atmosphere of $2\times10^{-1}$ Torr to have thickness of 1,000 Å as the electron injection blocking layer. The target section of a photoconductive image pick-up tube having a blocking type structure is thus obtained.

The target section of the image pick-up tube derived by the EXAMPLE 26 or 27 is incorporated into the casing of the image pick-up tube containing an electron gun therein, resulting in a photoconductive image pick-up tube. When the resultant image pick-up tube is operated in electric field of $8\times10^7$ to $2\times10^8$ V/m, the signal is amplified in the amorphous semiconductor layer. When the electric field has a value of $1.2\times10^8$ V/m, the obtained output is 10 times that obtained when the incident light is entirely converted into a signal.

In the EXAMPLES 26 and 27, it is also possible to insert a vacuum-evaporated layer comprising cerium oxide and having layer thickness of 300 Å, for example, as the auxiliary rectifying function layer between the transparent electrode and the amorphous semiconductor layer. In this case, the function of blocking injection of holes from the transparent electrode is enhanced. Accordingly, operation in higher electric field becomes possible, and sensitivity with charge multiplication factor not less than 10 is obtained.

EXAMPLE 28

A transparent electrode mainly comprising indium oxide is formed on a glass electrode. On this transparent electrode, a thin film comprising amorphous silicon nitride containing hydrogen and having thickness of 100 to 1,000 Å is formed as the hole injection blocking layer. Succeedingly, amorphous silicon containing hydrogen is deposited by 0.05 to 3 μm by decomposing monosilane with glow discharge while keeping the substrate at 200 to 300° C. Further thereon, Se containing arsenic at a ratio of 20% is vapor-deposited by 300 Å as the intermediate layer, and succeedingly Se containing arsenic at the ratio of 2% is vacuum-deposited to have thickness of 0.05 to 6 μm. On the amorphous Se layer, $Sb_2S_3$ is evaporated in the inert gas atmosphere of $2\times10^{-1}$ Torr to have thickness of 1,000 Å as the electron injection blocking layer. The target section of a photoconductive image pick-up tube having a blocking type structure is thus obtained.

EXAMPLE 29

A transparent electrode mainly comprising indium oxide is formed on a glass substrate. On the transparent electrode, a thin layer comprising amorphous silicon nitride containing hydrogen and having thickness of 100 to 1,000 Å is formed as the hole injection blocking layer. Succeedingly, amorphous silicon containing boron at the ratio of 5 ppm is deposited by 0.05 to 3 μm by decomposing mixed gas of monosilane and diborane with glow discharge while keeping the substrate at 200° to 300° C. As intermediate layers, amorphous Se containing tellurium at the ratio of 30% is deposited by 200 Å, and amorphous Se having composition distribution in which the concentration of arsenic successively decreases from 20% to 2% is deposited by 500 Å. Further thereon, Se comprising arsenic at the ratio of 2% is vacuum-deposited to have thickness of 0.05 to 6 μm. On the amorphous Se layer, $Sb_2S_3$ is evaporated in the inert gas atmosphere of $2\times10^{-1}$ Torr to have thickness of 1,000 Å as the electron injection blocking layer. The target section of a photoconductive image pick-up tube having a blocking type structure is thus obtained.

The target section of a image pick-up tube derived in the EXAMPLE 28 or 29 is incorporated into the casing of the image pick-up tube containing an electron gun therein, resulting in a photoconductive image pick-up tube. When the resultant image pick-up tube is supplied with such voltage to be operated that the electric field strength applied to the charge multiplication layer becomes $8\times10^7$ to $2\times10^8$ V/m, the signal is amplified in the amorphous semiconductor layer. When the electric field strength applied to the charge multiplication layer is $1.2\times10^8$ V/m, for example, high sensitivity with gain close to 10 has been obtained.

EXAMPLE 30

A transparent electrode mainly comprising indium oxide is formed on a transparent substrate. On this transparent substrate, CdSe is vacuum-evaporated to have layer thickness of 0.01 to 1 μm as the optical carrier generation layer. After this glass face plate has undergone heat processing at the temperature of 200° to 400° C. in oxygen atmosphere, amorphous Se is vacuum-deposited thereon to have thickness of 0.05 to 6 μm. On the amorphous Se layer, $Sb_2S_3$ is evaporated in the inert gas atmosphere of $2\times10^{-1}$ Torr to have thickness of 1,000 Å as the electron injection blocking layer. The target section of a photoconductive image pick-up tube having a blocking type structure is thus obtained.

EXAMPLE 31

A transparent electrode mainly comprising indium oxide is formed on a transparent substrate. Further thereon, the same optical carrier generation layer as the EXAMPLE 27 is disposed. Further thereon, an amorphous semiconductor layer comprising amorphous Se and As, or Se and Ge and having layer thickness of 0.05 to 6 μm is vacuum-deposited. On the amorphous semiconductor layer, $Sb_2S_3$ is evaporated in the inert gas atmosphere of $2\times10^{-1}$ Torr to have thickness of 1,000 Å as the electron injection blocking layer. The target section of a photoconductive image pick-up tube having a blocking type structure is thus obtained.

EXAMPLE 32

A transparent electrode mainly comprising indium oxide is formed on a transparent substrate. As the optical carrier generation layer on the transparent electrode, ZnSe is vacuum-deposited to have layer thickness of 0.01 to 0.1 μm, and the ZnCdTe compound is vacuum-deposited to have thickness of 0.1 to 1 μm. After this glass face plate has undergone heat processing at the temperature of 200° to 600° C. in the oxygen atmosphere, amorphous Se is vacuum-deposited on the glass face plate to have thickness of 0.05 to 6 μm. On the amorphous Se layer, $Sb_2S_3$ is evaporated in the inert gas atmosphere of $2\times10^{-1}$ Torr to have thickness of 1,000 Å as the electron injection blocking layer. The target section of a photoconductive image pick-up tube having a blocking type structure is thus obtained.

EXAMPLE 33

A transparent electrode mainly comprising indium oxide is formed on a substrate transmitting the signal light. On this transparent electrode, a layer comprising PbS and PbO is vacuum-deposited to have layer thickness of 0.01 to 1 μm. Further thereon, amorphous Se is vacuum-deposited to have thickness of 0.05 to 6 μm. On the amorphous Se layer, $Sb_2S_3$ is evaporated in the inert gas atmosphere of $2\times10^{-1}$ Torr to have thickness of 1,000 Å as the electron injection blocking layer. The target section of a photoconductive image pick-up tube having a blocking type structure is thus obtained.

EXAMPLE 34

A transparent electrode comprising a transparent thin metal layer is formed on a substrate transmitting the signal light. On this transparent electrode, the HgCdTe compound is deposited to have layer thickness of 0.01 to 0.1 μm as the optical carrier generation layer. Further thereon, amorphous Se is vacuum-deposited to have thickness of 0.05 to 6 μm. On the amorphous Se layer, $Sb_2S_3$ is evaporated in the inert gas atmosphere of $2\times10^{-1}$ Torr to have thickness of 1,000 Å as the electron injection blocking layer. The target section of a photoconductive image pick-up tube is thus obtained.

The target section of an image pick-up tube derived by the EXAMPLE 30, 31, 32, 33 or 34 is incorporated into the casing of the image pick-up tube containing an electron gun therein, resulting in a photoconductive image pick-up tube. When the resultant image pick-up tube is supplied with such voltage to be operated that the electric field applied to the charge multiplication layer becomes $8\times10^7$ to $2\times10^8$ V/m, the signal is amplified in the charge multiplication layer comprising amorphous semiconductor. When the electric field applied to the charge multiplication layer has a value of $1.2\times10^8$ V/m, for example, the obtained output is 10 times that obtained when the incident light is entirely converted into a signal current.

EXAMPLE 35

A glass substrate having a transparent electrode mainly comprising indium oxide on the surface thereof is disposed in the sputtering apparatus. On this transparent electrode, a thin $SiO_2$ layer having thickness of 100 to 1,000 Å is deposited as the hole injection blocking layer. While the substrate is kept at 200° to 300° C., mixed gas of hydrogen and argon is introduced, and high frequency power is applied to polycrystalline silicon disposed on the electrode. On the substrate, amorphous silicon containing hydrogen is deposited to have thickness of 0.05 to 3 μm. Further thereon, amorphous Se is vacuum-deposited to have thickness of 0.05 to 6 μm. On the amorphous Se layer, $Sb_2S_3$ is evaporated in the inert gas atmosphere of $2\times10^{-1}$ Torr to have thickness of 1,000 Å as the electron injection blocking layer. The target section of a photoconductive image pick-up tube having a blocking type structure is thus obtained.

EXAMPLE 36

A transparent electrode mainly comprising indium oxide is formed on a glass substrate. On this transparent electrode, the same optical carrier generation layer comprising amorphous silicon as the embodiment 35 is disposed. Further thereon, an amorphous semiconductor layer comprising amorphous Se and As, or Se and Ge and having layer thickness of 0.05 to 6 μm is vacuum-evaporated. Further thereon, $Sb_2S_3$ is evaporated in the inert gas atmosphere of $2\times10^{-1}$ Torr to have thickness of 1,000 Å as the electron injection blocking layer. The target section of a photoconductive image pick-up tube having a blocking type structure is thus obtained.

The target section of an image pick-up tube derived according to the EXAMPLE 35 or 36 is incorporated into the casing of an image pick-up tube containing an electron gun therein, resulting in a photoconductive image pick-up tube. When the resultant image pick-up tube is supplied with such voltage to be operated that the electric field strength applied to the charge multiplication layer becomes $8\times10^7$ to $2\times10^8$ V/m, the signal is amplified in the amorphous semiconductor layer. When the electric field strength applied to the charge multiplication layer is $1.2\times10^8$ V/m, high sensitivity with gain close to 10 is obtained.

EXAMPLE 37

A transparent electrode mainly comprising tin oxide is formed on a glass substrate. As the auxiliary rectifying contact layer, $GeO_2$ and $CeO_2$ are vapor-deposited in the vacuum of $3\times10^{-6}$ Torr to have thickness of 200 Å and 200 Å, respectively. As an amorphous semiconductor layer thereon, Se and $As_2Se_3$ are vapor-deposited from respective evaporation boats to have thickness of 1 μm. In this case, the concentration of As is defined to 2% in weight proportion and distributed uniformly in the layer thickness direction. The amorphous semiconductor layer is vapor-deposited in the vacuum of $2\times10^{-6}$ Torr. On this amorphous semiconductor layer, $Sb_2S_3$ is evaporated in the argon atmosphere of $3\times10^{-1}$ Torr to have thickness of 800 Å as the electron injection blocking layer. The target section thus formed is incorporated into an image pick-up tube. The amorphous semiconductor layer of the image pick-up tube is operated in the electric field of $8\times10^7$ V/m to $2\times10^8$ V/m causing the charge multiplication.

EXAMPLE 38

A transparent electrode mainly comprising indium oxide is formed on a glass substrate. On this transparent electrode, $CeO_2$ is evaporated in vacuum of $3\times10^{-6}$ Torr to have thickness of 300 Å as the auxiliary rectifying contact layer. Further thereon, Se is evaporated in the vacuum of $2\times10^{-6}$ Torr to have thickness of 2 μm as the amorphous semiconductor layer. On this amorphous semiconductor layer, $Sb_2S_3$ is evaporated in the argon atmosphere of $2\times10^{-1}$ Torr to have thickness of 1,000 Å as the electron injection blocking layer. The target section thus formed is incorporated into an image pick-up tube. The amorphous semiconductor layer of the resultant image pick-up tube is operated in the electric field of $8\times10^7$ to $2\times10^8$ V/m causing the charge multiplication.

EXAMPLE 39

A transparent electrode mainly comprising indium oxide is formed on a glass substrate. Further as the auxiliary rectifying contact layer, $GeO_2$ and $CeO_2$ are vapor-deposited to have thickness of 200 Å and 200 Å, respectively. This vapor deposition is carried out in the vacuum of $2\times10^{-6}$ Torr. Subsequently, an amorphous semiconductor layer is vapor-deposited. In order to form the amorphous semiconductor layer, Se and $As_2Se_3$ are at first evaporated from respective evaporation boats and deposited to have thickness of 300 Å. In this case, the As concentration is defined to be 3% in weight proportion and distributed uniformly in the layer thickness direction. Subsequently, Se, $As_2Se_3$ and LiF are evaporated from respective different evaporation boats and vapor-deposited to have thickness of 600 Å. The As concentration at this time is 2% in weight proportion, and the LiF concentration is 2,000 ppm in weight proportion and distributed uniformly in the layer thickness direction. Further thereon, Se and $As_2Se_3$ are evaporated from respective evaporation boats and vapor-deposited to have thickness of 1.4 μm. In this case, the As concentration is defined to be 2% in weight proportion and distributed uniformly in the layer thickness direction. The evaporation of the amorphous semiconductor layer is thus finished. The evaporation of amorphous semiconductor layer is carried out in the vacuum of $2\times10^{-6}$ Torr. An electron injection blocking layer is vapor-deposited on the amorphous semiconductor layer. In the argon atmosphere of $3\times10^{-1}$ Torr, $Sb_2S_3$ is evaporated to have thickness of 900 Å as the electron injection blocking layer. The target thus formed is incorporated in an image pick-up tube. The amorphous semiconductor layer of the image pick-up tube is operated in the electric field of $7\times10^{7}$ to $2\times10^{8}$ V/m causing the charge multiplication.

EXAMPLE 40

A transparent electrode mainly comprising indium oxide is formed on a glass substrate. Further, $CeO_2$ is evaporated in the vacuum of $3\times10^{-6}$ Torr to have thickness of 300 Å as the auxiliary rectifying contact layer. On that auxiliary rectifying contact layer, Se and $As_2Se_3$ are at first evaporated from respective different evaporation boats to have thickness of 1.4 μm as the amorphous semiconductor layer. The As concentration at this time is defined to be 3% in weight proportion, and the concentration of $In_2O_3$ is defined to be 500 ppm in weight proportion. These concentrations are uniformly distributed in the layer thickness direction. Evaporation of the amorphous semiconductor layer is thus finished. Evaporation of the amorphous semiconductor layer is carried out in the vacuum of $2\times10^{-6}$ Torr. On the amorphous semiconductor layer, $Sb_2S_3$ is evaporated in the argon atmosphere of $3\times10^{-1}$ Torr to have thickness of 900 Å as the electron injection blocking layer. The target section thus formed is incorporated into an image pick-up tube. The amorphous semiconductor layer of the image pick-up tube is operated in the electric field of $7\times10^{7}$ to $2\times10^{8}$ V/m causing the charge multiplication.

EXAMPLE 41

A transparent electrode mainly comprising tin oxide is formed on a glass substrate. Further, $GeO_2$ and $CeO_2$ are evaporated in the vacuum of $3\times10^{-6}$ Torr to respectively have thickness of 200 Å and 200 Å as the auxiliary rectifying contact layer. Further thereon, an amorphous semiconductor layer is vapor-deposited. The amorphous semiconductor layer is formed as described below. At first, Se and $As_2Se_3$ are vapor-deposited to have thickness of 300 Å by respective different evaporation boats. The As concentration at this time is defined to be 6% in weight proportion and distributed uniformly in the layer thickness direction. Subsequently, Se, $As_2Se_3$ and LiF are vapor-deposited to have thickness of 600 Å by respective different evaporation boats. In this case, the As concentration is defined to be 2% in weight proportion, and the LiF concentration is defined to be 4,000 and distributed uniformly in the layer thickness direction. Subsequently, Se and $As_2Se_3$ are vapor-deposited to have thickness of 1.5 μm by respective different evaporation boats. In this case, the concentration of As is defined to be 2% in weight proportion and distributed uniformly in the layer thickness direction. Further thereon, Se, $As_2Se_3$ and $In_2O_3$ are vapor-deposited to have thickness of 2,000 Å by respective different evaporation boats. The As concentration at this time is defined to be 3% in weight proportion, and the concentration of $In_2O_3$ is defined to be 700 ppm in weight proportion and distributed uniformly in the layer thickness direction. Further thereon, Se and $As_2Se_2$ are vapor-deposited to have thickness of 2,000 Å by respective different evaporation boats. In this case, the concentration of As is defined to be 2% in weight proportion and distributed uniformly in the layer thickness direction. Evaporation of the amorphous semiconductor layer is thus finished. Evaporation of the amorphous semiconductor layer is carried out in the vacuum of $3\times10^{-6}$ Torr. On this amorphous semiconductor layer, $Sb_2S_3$ is evaporated in the argon atmosphere of $2\times10^{-1}$ Torr to have thickness of 1,000 Å as the electron injection blocking layer. The target section thus formed is incorporated into an image pick-up tube. The amorphous semiconductor layer of the image pick-up tube is operated in the electric field of $7\times10^{7}$ to $2\times10^{8}$ V/m causing charge multiplication.

EXAMPLE 42

A transparent electrode mainly comprising indium oxide is formed on a glass substrate. Further, $CeO_2$ is evaporated in the vacuum of $3\times10^{-6}$ Torr to have thickness of 200 Å as the auxiliary rectifying contact layer. Further thereon, an amorphous semiconductor layer is vapor-deposited. The amorphous semiconductor layer is formed as described below. At first, Se and $As_2Se_3$ are vapor-deposited to have thickness of 5,000 Å by respective different evaporation boats. The concentration of As at this time is defined to be 3% in weight proportion and distributed uniformly in the layer thickness direction. Subsequently, Se and $As_2Se_3$ are vapor-deposited to have thickness of 300 Å by respective different evaporation boats. In this case, the concentration of As is defined to be 20% in weight proportion and distributed uniformly in the layer thickness direction. Subsequently, Se and $As_2Se_3$ are vapor-deposited to have thickness of 5,000 Å by respective different evaporation boats. The concentration of As in this case is defined to be 3% in weight proportion and distributed uniformly in the layer thickness direction. Further thereon, Se and $As_2Se_3$ are vapor-deposited to have thickness of 300 Å by respective different evaporation boats. The concentration of As at this time is defined to be 20% in weight proportion and distributed uniformly in the layer thickness direction. Further thereon, Se and $As_2Se_3$ are vapor-deposited to have thickness of 5,000 Å by respective different boats. The concentration of As in this case is defined to be 10% in weight proportion and distributed uniformly in the layer thickness direction. Evaporation of the amorphous semiconductor layer is thus finished. Evaporation of the amorphous semiconductor layer is carried out in the vacuum of $3\times10^{-6}$ Torr. An electron injection blocking layer is evaporated on the amorphous semiconductor layer. The electron injection blocking layer is formed by evaporating $Sb_2S_3$ in the argon atmosphere of $3\times10^{-1}$ Torr to have thickness of 900 Å. The target thus formed is incorporated into an image pick-up tube. The amorphous semiconductor layer of the image pick-up tube is operated in the electric field of $5\times10^7$ to $2\times10^8$ V/m causing charge multiplication.

EXAMPLE 43

A transparent electrode mainly comprising tin oxide is formed on a glass substrate. Further, $GeO_2$ and $CeO_2$ are evaporated in the vacuum of $2\times10^{-6}$ Torr to respectively have 150 Å as an auxiliary rectifying contact layer. Further thereon, an amorphous semiconductor layer is vapor-deposited. The amorphous semiconductor layer is formed as described below. At first, Se and $As_2Se_3$ are vapor-deposited from respective different evaporation boats to have thickness of 600 Å. The concentration of As at this time is defined to be 3% in weight proportion and distributed uniformly in the layer thickness direction. Subsequently, Se and $As_2Se_3$ are vapor-deposited from respective different evaporation boats to have thickness of 150 Å. The concentration of As in this case is defined to be 10% in weight proportion and distributed uniformly in the layer thickness direction. Subsequently, Se, Te, $As_2Se_3$ and LiF are vapor-deposited to have thickness of 900 Å by respective different evaporation boats. In this case, the concentrations of Te, As and LiF are 15%, 2% and 4,000 ppm in weight proportion and distributed uniformly in the layer thickness direction. Further thereon, Se, $As_2Se_3$ and $In_2O_3$ are vapor-deposited to have thickness of 150 Å by respective different evaporation boats. The concentration of As at this time is defined to be 25% in weight proportion, and the concentration of $In_2O_3$ is defined to be 500 ppm in weight proportion. These concentrations are distributed uniformly in the layer thickness direction. Further thereon, Se and $As_2Se_3$ are vapor-deposited to have thickness of 1.8 μm by respective different boats. The concentration of As in this case is defined to be 2% in weight proportion and distributed uniformly in the layer thickness direction. Evaporation of the amorphous semiconductor layer is thus finished. Evaporation of the amorphous semiconductor layer is carried out in the vacuum of $2\times10^{-6}$ Torr. Succeedingly, an electron injection blocking layer is vapor-deposited on the amorphous semiconductor layer. The electron injection blocking layer is formed by vapor-depositing $Sb_2S_3$ to have thickness of 1,000 Å in the argon atmosphere of $3\times10^{-1}$ Torr. The target thus formed is incorporated into an image pick-up tube. The amorphous semiconductor layer of the image pick-up tube is operated in the electric field of $5\times10^7$ to $2\times10^8$ V/m causing charge multiplication.

EXAMPLE 44

A transparent electrode mainly comprising indium oxide is formed on a glass substrate. Further, $CeO_2$ is evaporated in the vacuum of $3\times10^{-6}$ Torr to have thickness of 200 Å as the auxiliary rectifying contact layer. On that contact layer, an amorphous semiconductor layer is vapor-deposited. The amorphous semiconductor layer is formed as described below. At first, Se and $As_2Se_3$ are vapor-deposited to have thickness of 2,000 Å by respective different evaporation boats. The concentration of As at this time is defined to be 3% and distributed uniformly in the layer thickness direction. Subsequently, Se, $As_2Se_3$ and LiF are vapor-deposited to have thickness of 500 Å by respective different evaporation boats. In this case, the concentration of As is 1% in weight proportion and the concentration of LiF is 2,000 ppm in weight proportion. These concentrations are distributed uniformly in the layer thickness direction. Subsequently, Se, $As_2Se_3$ and Te are vapor-deposited to have thickness of 1 μm by respective different evaporation boats. In this case, the concentration of As is 1% in weight proportion and distributed uniformly in the layer thickness direction. The concentration of Te is increased at a constant slope in the range of layer thickness 1 μm. At the start of Te evaporation, the concentration of Te is 1% in weight proportion. At the end of Te evaporation, the concentration of Te is 1.5% in weight proportion. Subsequently, Se and $As_2Se_3$ are vapor-deposited to have thickness of 150 Å by respective different evaporation boats. In this case, the concentration of As is defined to be 20% in weight proportion and distributed uniformly in the layer thickness direction. Further thereon, Se and $As_2Se_3$ are vapor-deposited to have thickness of 2,500 Å by respective different evaporation boats. The concentration of As at this time is defined to be 2% in weight proportion and distributed uniformly in the layer thickness direction. Evaporation of the amorphous semiconductor layer is thus finished. Evaporation of the amorphous semiconductor layer is carried out in the vacuum of $2\times10^{-6}$ Torr. On the amorphous semiconductor layer, $Sb_2S_3$ is evaporated in the argon atmosphere of $2\times10^{-1}$ Torr to have thickness of 900 Å as the electron injection blocking layer. The target section thus formed is incorporated into an image pick-up tube. The amorphous semiconductor layer of the image pick-up tube is operated in the electric field of $6\times10^7$ to $2\times10^8$ V/m causing charge multiplication.

EXAMPLE 45

A transparent electrode mainly comprising tin oxide is formed on a glass substrate. Further, a hydride amorphous silicon nitride layer is formed to have layer thickness of 200 Å as the auxiliary rectifying contact layer by using the glow discharge technique. A hydride amorphous silicon layer is formed to have layer thickness of 2,000 Å by using the glow discharge technique. Further thereon, Se and $As_2Se_3$ are vapor-deposited to have thickness of 130 Å by respective different evaporation boats. The concentration of As in this case is defined to be 30% in weight proportion and distributed uniformly in the layer thickness direction. Further thereon, Se and $As_2Se_3$ are vapor-deposited to have thickness of 1.8 μm by respective different evaporation boats. The concentration of As at this time is defined to be 2% in weight proportion and distributed uniformly in the layer thickness direction. Evaporation of Se and $As_2Se_3$ of the amorphous semiconductor layer is carried out in the vacuum of $3\times10^{-6}$ Torr. Subsequently, an electron injection blocking layer is vapor-deposited. The electron injection blocking layer is formed by evaporating $Sb_2S_3$ in the argon atmosphere of $3\times10^{-1}$ Torr to have thickness of 1,000 Å. The target section thus formed is incorporated into an image pick-up tube. The amorphous semiconductor layer of the image pick-up tube is operated in the electric field of $6\times10^7$ to $2\times10^8$ V/m causing charge multiplication.

EXAMPLE 46

A transparent electrode mainly comprising tin oxide is formed on a glass substrate. Subsequently, an amorphous semiconductor layer is vapor-deposited. The amorphous semiconductor layer is formed as described below. At first, Se is vapor-deposited to have thickness of 1,000 Å. Subsequently, Se and LiF are vapor-deposited to have thickness of 1,000 Å by respective different evaporation boats. The concentration of LiF at this time is defined to be 3,000 ppm in weight proportion and distributed uniformly in the layer thickness direction. Further thereon, Se is vapor-deposited to have thickness of 1.8 μm. Evaporation of the amorphous semiconductor layer is thus finished. Evaporation of the amorphous semiconductor layer is carried out in the vacuum of $2\times10^{-6}$ Torr. An electron injection blocking layer is vapor-deposited on the amorphous semiconductor layer. The electron injection blocking layer is formed by vapor-depositing $Sb_2S_3$ in the argon atmosphere of $3\times10^{-1}$ Torr to have thickness of 1,000 Å. The target section thus formed is incorporated into an image pick-up tube. The amorphous semiconductor layer of the image pick-up tube is operated in the electric field of $7\times10^7$ to $2\times10^8$ V/m causing charge multiplication.

EXAMPLE 47

A transparent electrode mainly comprising tin oxide is formed on a glass substrate. On this transparent electrode, an amorphous semiconductor comprising Se-As-Te and having thickness of 0.05 to 6 μm is vapor-deposited. On the amorphous Se-family layer, $Sb_2S_3$ is evaporated in the inert gas atmosphere of $2\times10^{-1}$ Torr to have thickness of 0.1 μm as the electron injection blocking layer. The target section of a photoconductive image pick-up tube having a blocking type structure is thus obtained. The target section of an image pick-up tube thus obtained is incorporated into the casing of an image pick-up tube containing an electron gun therein, resulting in a photoconductive image pick-up tube. The resultant image pick-up tube is incorporated into a TV camera capable of controlling the temperature of the target section. The TV camera contains heat generators including a deflection coil of an image pick-up tube, a heater for generating the electron beam, and a signal processing circuit. As the above described temperature control mechanism, therefore, the TV camera may have cooling function. Cooling is attained by blowing outside air against the target by means of a small-sized blowing fan when a temperature such as a thermocouple or a thermistor finds that the temperature of the target section has risen up to the temperature set point. The cooling method is not necessarily limited to the above described method. For example, the target can be cooled by operating a thermoelectric cooling device attached to the vicinity of the target section or by inserting an insulative medium having heat conduction function between the target section and the cooling section. The target section is kept at 35° C., for example, by using such a method, and operated in the target electric field not less than $8\times10^7$ V/m. As a result, the signal is amplified in the amorphous semiconductor layer. When the electric field has a value of $1.2\times10^8$ V/m, for example, the output with the gain not less than 10 can be obtained while restraining the HAI to a low value.

Further, a vacuum-evaporated layer comprising cerium oxide and having layer thickness of 0.03 μm, for example, may be inserted as the auxiliary rectifying contact layer between the transparent electrode and the amorphous semiconductor layer. In this case, the function of blocking injection of holes from the transparent conductive layer is enhanced. As a result, operation in higher electric field becomes possible and further high sensitivity is obtained.

What is claimed is:

1. A photoconductive device having an image pick-up tube comprising:

a substrate;

an electrode formed on or above the substrate;

a photoconductive layer formed on or above the electrode, having an amorphous semiconductor layer which is capable of charge multiplication, and having a blocking type contact for preventing charge injection under an applied electric field which induces the charge multiplication in the amorphous semiconductor layer; and a means for applying the electric field to the amorphous semiconductor layer so as to induce the charge multiplication in the amorphous semiconductor layer.

2. A photoconductive device as claimed in claim 1, wherein said amorphous semiconductor layer is made of amorphous semiconductor which primarily consists of Se.

3. A photoconductive device as claimed in claim 2, wherein said amorphous semiconductor layer includes at least one element selected from the group consisting of Te, Sb, Cd, Cd and Bi in at least a partial region of the layer thickness direction.

4. A photoconductive device as claimed in claim 1, wherein said photoconductive layer includes an optical carrier generation layer for absorbing incident light and generating most of optical carriers and a charge multiplication layer for multiplying said generated optical carriers.

5. A photoconductive device as claimed in claim 1, wherein said electrode is transparent.

6. A photoconductive device as claimed in claim 1, wherein an auxiliary contact layer of blocking type is disposed between said electrode and said photoconductive layer.

7. A photoconductive device as claimed in claim 2, wherein said photoconductive device has a temperature adjusting means which makes temperature of said photoconductive layer not exceed 40° C.

8. A photoconductive device as claimed in claim 2, wherein said amorphous semiconductor layer has thickness h characterized as $0.5\mu m \leqq h \leqq 10\mu m$.

9. A photoconductive device as claimed in claim 2, wherein said amorphous semiconductor layer comprises at least one of As and Ge.

10. A photoconductive device as claimed in claim 2, wherein said amorphous semiconductor layer comprises a material for forming hole traps in at least a part of said amorphous semiconductor layer in its layer thickness direction.

11. A photoconductive device as claimed in claim 2, wherein said amorphous semiconductor layer comprises a material for forming electron traps in at least a part of said amorphous semiconductor layer in its layer thickness direction.

12. A photoconductive device as claimed in claim 3, wherein said region is disposed in said amorphous semiconductor layer at a distance from said electrode.

13. A photoconductive device as claimed in claim 3, wherein the concentration in said amorphous semiconductor layer of at least one element selected from the group consisting of Te, Sb, Cd and Bi and contained in said region is not less than 0.01 weight % and not larger than 50 weight % on the average.

14. A photoconductive device as claimed in claim 10, wherein said material forming hole traps comprise at least one member selected from the group consisting of Li, Na, K, Mg, Ca, Ba, Tl, Al, Cr, Mn, Co, Pb, Ce and fluorides thereof.

15. A photoconductive device as claimed in claim 10, wherein said material forming hole traps is contained in a part of said amorphous semiconductor layer at the light incidence side.

16. A photoconductive device as claimed in claim 10, wherein the local concentration in said amorphous semiconductor layer of said hole trap forming material is not less than 20 weight ppm and not larger than 10 weight %.

17. A photoconductive device as claimed in claim 11, wherein said electron trap forming material comprises at least one member selected from the group consisting of oxidized copper, indium oxide, selenium oxide, vanadium oxide, molybdenum oxide, tungsten oxide, gallium fluoride, indium fluoride, Zn, Ga, In, Cl, I and Br.

18. A photoconductive device as claimed in claim 11, wherein said electron trap forming material is contained in a part of said amorphous semiconductor layer near an electron beam scanning side.

19. A photoconductive device as claimed in claim 11, wherein the local concentration of said electron trap forming material in said amorphous semiconductor layer is not less than 20 weight ppm and not larger than 10 weight %.

20. A photoconductive device as claimed in claim 4, wherein said optical carrier generation layer is disposed at the light incidence side of said photoconductive layer with respect to said charge multiplication layer.

21. A photoconductive device as claimed in claim 4, wherein said photoconductive layer comprises an intermediate layer between said optical carrier generation layer and said charge multiplication layer, and said intermediate layer is different from said optical carrier generation layer and said charge multiplication layer in band gap or electric field.

22. A photoconductive device as claimed in claim 4, wherein said optical carrier generation layer primarily consists of a first material which is a combination of at least one element selected from a third group comprising Zn, Cd, Hg and Pb and at least one element selected from a fourth group comprising O, S, Se and Te.

23. A photoconductive device as claimed in claim 4, wherein said optical carrier generation layer primarily consists of an amorphous material of tetrahedral family comprising halogen or hydrogen.

24. A photoconductive device as claimed in claim 4, wherein said optical carrier generation layer comprises a material which primarily consists of amorphous Si.

25. A photoconductive device as claimed in claim 21, wherein said intermediate layer comprises a material including an amorphous semiconductor which primarily consists of Se and includes a first other substance and said charge multiplication layer is made of amorphous semiconductor which primarily consists of Se.

26. A photoconductor device as claimed in claim 25, wherein said first other substance comprises at least one of bismuth, cadmium, and their chalcogenide compounds, tellurium, tin, arsenic, germanium, antimony, indium, gallium, and their chalcogenide compounds, sulphur, chlorine, iodine, bromine, oxidized copper, indium oxide, selenium oxide, vanadium oxide, molybdenum oxide, tungsten oxide, gallium fluoride, and indium fluoride.

27. A photoconductive device as claimed in claim 21, wherein said intermediate layer comprises at least a material including an amorphous substance which is primarily comprised of Se and includes a second other substance.

28. A photoconductive device as claimed in claim 27, wherein said second other substance comprises at least one element selected from a first group of elements including germanium, carbon, nitrogen and tin, and a second group of elements including elements of III and V families.

29. A photoconductive device as claimed in claim 22, wherein said first material comprises at least one compound selected from the group consisting of ZnS, CdS, ZnSe, CdSe, ZnTe, CdTe, HgCdTe, PbO and PbS.

30. A photoconductive device as claimed in claim 23, wherein said halogen comprises at least one selected out of fluoride and chlorine.

31. A photoconductive device as claimed in claim 5, wherein said electrode comprises a metal.

32. A photoconductive device as claimed in claim 31, wherein said electrode comprises at least one element selected from the group consisting of Cu, Ag, Au, Al, In, Ti, Ta, Cr, Mo, Ni and Pt.

33. A photoconductive device as claimed in claim 6, wherein said auxiliary contact layer of blocking type comprises a single layer of cerium oxide, or laminates comprising cerium oxide and an oxide of at least one element selected from the group consisting of Ge, Zn, Cd, Al, Si, Nb, Ta, Cr and W.

34. A photoconductive device of charge injection blocking type comprising:

a target section having a transparent substrate;

a transparent electrode formed on said transparent substrate;

a photoconductive layer formed on said transparent electrode to apply photoelectric conversion to incident light, said photoconductive layer having blocking type contact and comprising an amorphous semiconductor layer capable of charge multiplication in at least a part of said photoconductive layer;

an electron beam control section for emitting, accelerating, deflecting and focusing an electron beam to scan said target section; and a means for applying the electric field to the amorphous semiconductor layer so as to induce the charge multiplication in the amorphous semiconductor layer.

35. A photoconductive device as claimed in claim 34, wherein said amorphous semiconductor layer comprises an amorphous semiconductor which primarily consists of Se.

36. A method of operating a photoconductive device having an image pick-up tube having a photoconductive layer including an amorphous semiconductor layer in a part of said photoconductive layer, wherein said amorphous semiconductor layer includes a material capable of charge multiplication, comprising the step of:

operating said photoconductive layer in an electric field region so as to induce charge multiplication within said amorphous semiconductor layer.

37. A method of operating a photoconductive device as claimed in claim 36, wherein said amorphous semiconductor layer comprises a material which primarily consists of Se, and said electric field region is in the range from $5\times10^7$ to $2\times10^8$ V/m.

38. A photoconductive device having an image pick-up tube comprising:

a substrate;

a photoconductive layer formed on or above the substrate, having an amorphous semiconductor layer being capable of charge multiplication therein;

means for applying electric field to the amorphous semiconductor layer so as to induce the charge multiplication in the amorphous semiconductor layer; and means for blocking charge injection from the means for applying into the amorphous semiconductor layer.

39. The photoconductive device as set forth in claim 38 wherein the amorphous semiconductor layer is made of amorphous semiconductor which primarily comprises Se.

40. The photoconductive device as set forth in claim 38, wherein the means for blocking substantially prevent the charge injection under the applied electric field which induce the charge multiplication in the amorphous semiconductor layer.

41. The photoconductive device having an image pick-up tube comprising:

a photoconductive layer converting incident light into photocarriers and multiplying carriers in an amorphous semiconductor layer of the photoconductive layer according to an electric field applied to the amorphous semiconductor layer;

means for applying the electric field to the amorphous semiconductor layer so as to induce avalanche multiplication phenomenon in the amorphous semiconductor layer; and means for blocking charge injection from the means for applying into the amorphous semiconductor layer.

42. The photoconductive device as set forth in claim 41, wherein the means for blocking substantially prevent the charge injection under the applied electric field which induce the avalanche multiplication phenomenon in the amorphous semiconductor layer.

43. The photoconductive device having an image pick-up tube comprising:

a photoconductive layer having the amorphous semiconductor layer being capable of charge multiplication and a structure for blocking charge injection; and means for applying electric field to the amorphous semiconductor layer so as to induce the charge multiplication and so as not to increase dark current in the amorphous semiconductor layer.

44. A photoconductive device having an image pick-up tube comprising:

a photoconductive layer having a photocarrier generation layer for absorbing incident light and generating most of photocarriers, and also having an amorphous semiconductor layer for multiplying carriers therein;

means for applying electric field to the amorphous semiconductor layer so as to induce avalanche multiplication phenomenon in the amorphous semiconductor layer; and means for blocking charge injection from the means for applying into the amorphous semiconductor layer.

45. The photoconductive device as set forth in claim 41, wherein the incident light is converted into the photocarriers in the amorphous semiconductor layer.

46. A photoconductive device having an image pick-up tube comprising:

a photoconductive layer having an amorphous semiconductor layer and a structure for charge blocking, wherein incident light is converted into photocarriers in the photoconductive layer, and the photocarriers are multiplied in the amorphous semiconductor layer; and means for applying electric field to the amorphous semiconductor layer so that gain of the photoconductive layer is not less than unity.

* * * * *